US006169811B1

(12) United States Patent
Croft, III

(10) Patent No.: US 6,169,811 B1
(45) Date of Patent: Jan. 2, 2001

(54) BANDPASS LOUDSPEAKER SYSTEM

(75) Inventor: James J. Croft, III, Poway, CA (US)

(73) Assignee: American Technology Corporation, San Diego, CA (US)

( * ) Notice: Under 35 U.S.C. 154(b), the term of this patent shall be extended for 0 days.

(21) Appl. No.: 09/260,309

(22) Filed: Mar. 2, 1999

(51) Int. Cl.[7] ..... H04R 25/00

(52) U.S. Cl. ..... 381/186; 381/163; 381/335; 381/345; 381/351; 179/1 E; 181/145; 181/156; 181/144

(58) Field of Search ..... 179/1 E; 181/144, 181/163, 147, 156, 145, 160, 199; 381/335, 186, 337, 338, 342, 345, 351, 163, 357, 180

(56) References Cited

U.S. PATENT DOCUMENTS 1,969,704 8/1934 d'Alton .
2,689,016 9/1954 Lang .

(List continued on next page.)

FOREIGN PATENT DOCUMENTS 0 125 625 11/1984 (DE) .
PCT/US98/20817 10/1998 (WO) .

OTHER PUBLICATIONS

Fincham, L.R. "A Bandpass Loudspeaker Enclosure" Journal of the Audio Engineering Society, Preprint, Presented at the 63rd Convention May 15 through 18, 1979, Los Angeles, pp. 1–16, figs 1–12.

(List continued on next page.)

*Primary Examiner*—Curtis A. Kuntz
*Assistant Examiner*—Dionne N. Harvey
(74) *Attorney, Agent, or Firm*—Thorpe, North & Western, L.L.P.

(57) ABSTRACT

A bandpass loudspeaker enclosure system including a first primary enclosure volume, a second primary enclosure volume and a dividing wall positioned between the first and second primary enclosure volumes and having a first opening therein. At least one electro-acoustic transducer is mounted at the opening on the dividing wall and includes a movable diaphragm having a first surface area side and a second surface area side. The first surface area side communicates into the first primary enclosure volume and the second surface area side of the movable diaphragm communicates into the second primary enclosure volume. At least one differential area passive radiator is provided, including (i) a primary diaphragm surface area having a primary peripheral attachment surround, and (ii) secondary diaphragm surface area having at least a secondary peripheral attachment surround. The secondary diaphragm surface area includes (1) a unitary diaphragm surface area having a perimeter defined by the secondary peripheral attachment surround and forms part of an interior surface of one of the first or second primary enclosure volumes, and (2) a differential diaphragm surface area having a first perimeter defined by the secondary peripheral attachment surround and a second perimeter defined by the primary peripheral attachment surround. The differential diaphragm surface area forms part of an interior surface of the remaining first or second primary enclosure volume. The unitary diaphragm surface area of the at least one differential area passive radiator is mounted by the secondary peripheral attachment surround in a second opening in a wall between the first and second primary enclosure volumes. The first surface area side of the electro-acoustic transducer being pneumatically coupled through the first primary enclosure volume to the unitary diaphragm surface area of the differential area passive radiator with the second surface area side of the electro-acoustical transducer pneumatically coupled through the second primary enclosure volume to the differential diaphragm surface area and the primary diaphragm surface area of the at least one differential area passive radiator mounted by the peripheral attachment surround in an opening in the second primary enclosure volume. The primary diaphragm surface area of the at least one differential area passive radiator communicates from the opening in the second primary enclosure volume to a region outside of the first and second primary enclosure volumes.

37 Claims, 16 Drawing Sheets

U.S. PATENT DOCUMENTS

| | | |
|---|---|---|
| 3,772,466 | 11/1973 | Hossbach . |
| 4,076,097 | 2/1978 | Clarke . |
| 4,301,332 | 11/1981 | Dusanek . |
| 4,387,275 | 6/1983 | Shimada et al. . |
| 4,549,631 | 10/1985 | Bose . |
| 4,875,546 | 10/1989 | Krnan . |
| 5,092,424 | 3/1992 | Schreiber . |

OTHER PUBLICATIONS

Clarke, Thomas L. "Augmented Passive–Radiator Loudspeaker Systems, Part 1" Ocean Acoustics Laboratory, Miami, FL 33149, USA, Journal of the Audio Engineering Society, Manuscript received Oct. 26, 1978; revised Dec. 30, 1980, pp. 221–240.

Geddes, Earl R., AES Fellow "The Acoustic Lever Loudspeaker Enclosure" J. Audio Eng. Soc., vol. 47, No. 1/2, 1999 Jan./Feb., pp. 3–13.

GedLee Associates (copyright 1998) "Speak 32", pp. 1–43.

BANDPASS LOUDSPEAKER SYSTEM

BACKGROUND OF THE INVENTION

The Field of the Invention

This invention relates to improved bandpass loudspeaker systems.

One of the prior art configurations relevant to the invention is the multi-chamber bandpass woofer system. Historically it has been shown that for a given restricted band of frequencies an acoustical bandpass enclosure system can produce greater performance both in terms of the efficiency/bass extension/enclosure size factor and large signal output compared to non-bandpass systems such as the basic sealed or bass reflex enclosures. The basic forms of these bandpass systems are discussed in the literature. See for example 'A bandpass loudspeaker enclosure' by L. R. Fincham, Audio Engineering Society convention preprint #1512, May.

The earliest patent reference to a single tuned bandpass woofer system is Lang, 'Sound Reproducing System' U.S. Pat. No. 2,689,016. This patent reference anticipates the most common version of bandpass woofer system that is used in many systems today. This type of system includes an enclosure with two separate chambers and an active transducer mounted in the dividing panel and communicating to both chambers. One chamber is sealed and the other is ported with a passive acoustic mass communicating to the environment outside the enclosure.

The earliest patent reference to a dual tuned bandpass woofer system is shown in FIG. 1 of U.S. Pat. No. 1,969,704, D'Alton, 'Acoustic Device'. This reference discloses an enclosure containing a two chamber bandpass woofer system with an active transducer mounted in the dividing panel and communicating to both chambers. Each chamber has a passive acoustic radiator communicating to the environment outside the enclosure. European patent 0125625 'Loudspeaker enclosure with integrated acoustic bandpass filter' by Bernhard Puls and U.S. Pat. No. 4,549,631 'Multiple porting loudspeaker systems' granted to Amar G. Bose are derived from the same basic structure as shown in the D'Alton reference.

An alternative arrangement of a dual tuned bandpass system is disclosed in the U.S. Pat. No. 4,875,546 'Loudspeaker with acoustic band-pass filter' granted to Palo Krnan. This system includes an enclosure with two separate chambers and an active transducer mounted in the dividing panel and communicating to both chambers. One chamber is ported with a passive acoustic radiator communicating to the environment outside the enclosure. There is a second passive acoustic radiator communicating internally between the two chambers.

U.S. Pat. No. 5,092,424 'Electroacoustical transducing with at least three cascaded subchambers' granted to Schreiber et al is an extension of the above listed bandpass art. It utilizes an enclosure with at least three chambers such that it is substantially equivalent to the Bose '631 patent listed above, but with an additional enclosure volume added to the outside of the main enclosure. This additional enclosure receives the two ports from the internal main chambers and an additional passive acoustic radiator communicates to the environment outside the system.

While offering certain advantages over non-bandpass prior art systems, such as the simple sealed box and the bass reflex, vented enclosure, these systems also exhibit a number of liabilities and limitations. One limitation is that the dual and triple chamber versions with multiple vent tunings, such as Bose, Scheiber, and Krnan all use much smaller chambers for their lowest frequency vent tuning. This requires a vent with greater losses than the vent in a generic bass reflex enclosure. This can cause significant overall losses in actual systems compared to the ideal theoretical lossless models of these systems. These systems also exhibit large diaphragm excursions at frequencies below the lowest vent tuning or 'cut-off' frequency and can have greater than normal diaphragm displacement at frequencies between the vent tunings. This can cause distortion and limit total system output. Also, the D'Alton, Puls and Bose systems are limited to narrow bandwidths if significant ripple in the frequency response is to be avoided. While reducing transducer excursion at the vent tuning frequencies, these systems can have greater transducer excursions at other frequencies in the passband which can cause distortion at high levels. They do not offer a way to reduce transducer excursion over their entire usable pass band.

Another group of prior art devices, relating to the invention, include loudspeaker systems with augmented passive radiators. The earliest of these systems is disclosed in U.S. Pat. No. 3,772,466 'Loud speaker system' granted to Hossbach which teaches the use of a high frequency active transducer coupled to an augmented passive radiator. Later versions of this type of system were granted to Clarke U.S. Pat. No. 4,076,097 and Dusanek U.S. Pat. No. 4,301,332. These devices are well characterized in "Augmented Passive-Radiator Loudspeaker Systems, Parts 1 and 2" by Thomas L. Clarke, found in the June and July, 1981 issues of the Journal of the Audio Engineering Society.

These prior art devices all configure their active transducers to radiate one side of their diaphragm surface area to the external environment outside of the main enclosure and the other side coupled through a chamber to one diaphragm surface area of an augmented passive radiator which is also coupled to the outside environment. The active transducer delivers the output at the higher frequencies and it drives the augmented passive radiator only over a very narrow band of lower frequencies. An augmented passive radiator is defined as a passive dual cone radiator that has one surface area coupled through the main enclosure volume to the active transducer, a second surface area coupled to the outside environment and a third surface area enclosed in a sealed auxiliary chamber. Because of this configuration these systems cannot produce an acoustically or mechanically generated lowpass or bandpass characteristic and therefore their performance is substantially limited to that of a simple non-bandpass vented system.

These inventors also teach the reflex tuning of the augmented passive radiators being the lowest reflex tuning frequency of the system rather than having an additional low frequency capability below the tuning of the augmented passive radiators. Therefore it is characteristic of these systems that the reflex frequency of their augmented passive radiators is always the lowest tuning frequency of the system and that tuning frequency is the low frequency cut-off of the system. The systems have little useful output when operated significantly below the reflex tuning frequency of the augmented passive radiator.

It is also a limitation of these systems that the active transducer has only one side of its cone interacting with the augmented passive radiator. It is a further limitation of these systems that they achieve the augmentation provided by their augmented passive radiators only at the narrow range of frequencies near the tuning frequency. At all other frequencies in the usable passband the active transducer must provide all of the volume displacement without any augmentation from the passive radiator. Also, these systems isolate the output of one of the surface areas of their augmented passive radiators into a sealed chamber so that only one surface area can generate acoustic output. To state it differently, an augmented passive radiator is a closed architecture system with an isolated auxiliary chamber that closes off the output and coupling of one of the two smaller coupling areas of the augmented passive radiator. An augmented passive radiator system, also always requires the greater cost and complexity of an additional auxiliary chamber.

U.S. Pat. No. 4,387,275 'Speaker and speaker system' granted to Shimada, et al discloses a unified transducer structure to be used in a sealed or vented enclosure. The unified transducer structure embodies a small loudspeaker cone attached to the voice coil of the transducer and this small cone is air-coupled and mechanically coupled to the inside of a larger cone which communicates to the outside environment. Because it is unified with a common surround and suspension shared between the small cone and the inside of the large cone, it is limited to a one to one ratio of the small active transducer cone coupling to the larger passive cone element and therefore the voice coil small cone area portion must have the same excursion capability as the large cone area. It is also not practical to make the coupling chamber very large with this structure which limits the alignments and chamber ratios that can be explored. This system also requires non standard, costly, complex construction with multiple support spiders and alignment calibration to maintain voice coil alignment which is difficult to achieve in production and does not lend itself to standard assembly techniques or automated production systems.

The above prior art systems require the active transducer to scale up in diameter or excursion capability to achieve greater outputs over their passbands. They do not have the ability to transform transducer force directly to increased passive radiator displacement to allow the volume displacement requirements of the active transducer to be scaled down over the entire pass band and/or they do not provide for a bandpass characteristic and its associated advantages.

OBJECTS AND SUMMARY OF THE INVENTION

It is an object of this invention to provide a loudspeaker that realizes both a bandpass characteristic and the use of a differential area passive radiator.

It is an object of this invention to eliminate the limitations of a closed architecture, augmented passive radiator by using an open architecture configuration of a differential area passive radiator.

It is a further object of this invention to utilize the differential area passive radiator to increase the cubic volume displacement capability of the active, electro-acoustic transducer over the entire pass band of the system.

It is an object of this invention to create a bandpass loudspeaker system that allows the active transducer to be scaled to various sizes without reducing large signal performance or to scale up the large signal performance for a given transducer cone area and excursion.

It is a further object of this invention to have the differential area passive radiator contribute acoustic output over the entire passband of the system as opposed to the narrow bandwidth of prior art applications of augmented passive radiators.

It is a further object of this invention to enlarge the low frequency chamber in a multi-chamber bandpass system, without increasing total enclosure volume, to minimize the losses of the passive acoustic energy-radiating element whether realized as a vent or suspended passive diaphragm.

It is a still further object of this invention to have the enclosure volume ratios be substantially scalable as desired without performance penalty.

It is a still further object of this invention to have single or multiple low pass characteristics to minimize distortion, reduce crossover requirements, minimize audible location detection, enhance the efficiency, reduce the enclosure volume, and/or extend the low frequency capability.

It is a still further object of this invention to reduce the low frequency out of band diaphragm excursions and therefore provide better large signal performance and reduce distortion and minimize transducer failure.

It is a still further object of this invention to freely adjust the bandwidth of the bandpass characteristic while minimizing ripple in the amplitude response.

It is a still further object of this invention to allow construction of the novel components of the system from standard component parts currently used in the loudspeaker industry.

It is a still further object of this invention to exhibit useful output and additional reflex tuning frequencies below the reflex tuning frequency of the passive differential area coupler.

It is a still further object of this invention to combine the output of a differential area passive radiator with one or more passive acoustic radiators such as an open vent, an elongated port, a suspended passive diaphragm or an augmented passive radiator.

It is a still further object of the invention to increase the transformed volume displacement of both sides of the active transducer at very low frequencies with the use of a single passive differential area radiator.

It is yet another object of the invention to increase the transformed volume displacement of both sides of the active transducer at very low frequencies with the use of a passive differential area radiator along with an augmented passive radiator in a bandpass configuration.

It is a still further object of the invention to combine the advantages of a differential area passive radiator with an acoustic transmission line.

Besides the increased effective acoustic output due to the ratio of the small to large diaphragms of the differential area passive radiator there is also a transformation available by choosing the ratio of active transducer diaphragm area to the diaphragm area of the differential area passive radiator interactive surface area. These transformations allow reduced transducer displacements and transform the transducer force into large movements and acoustic output from the differential area passive radiator.

The advantages that are exhibited in the numerous embodiments, that include additional passive acoustic energy radiating elements and/or additional chambers to enhance the bandpass characteristic and reduce the diaphragm motion of the electro-acoustic transducer, will become obvious to one skilled in the art as the invention is disclosed further in the detailed embodiments.

DETAILED DESCRIPTION OF THE INVENTION

Figure 1:
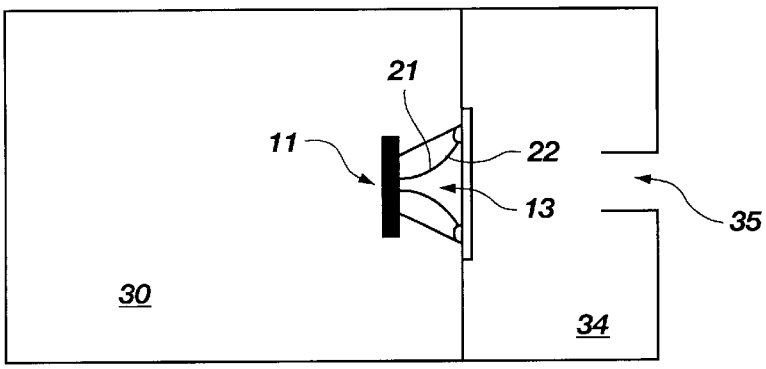
Fig. 1 (PRIOR ART)
FIG. 1 illustrates a prior art single reflex tuned bandpass enclosure.

FIG. 1 shows a prior art bandpass woofer system of U.S. Pat. No. 2,689,016, granted to Lang, in its simplest form with main enclosure 10 containing sub enclosure volumes 30 and 34 with a passive acoustic energy radiator 35 venting sub enclosure volume 34 to the outside environment. Other than at the vent tuning frequency, the maximum acoustic output of this system is substantially determined by the volume displacement capability of the electro-acoustic transducer itself. Even at the vent tuning frequency, the large signal output of this system cannot be maintained if the transducer cubic volume displacement is reduced; i.e. if the diameter or the excursion of the transducer is reduced.

Figure 2:
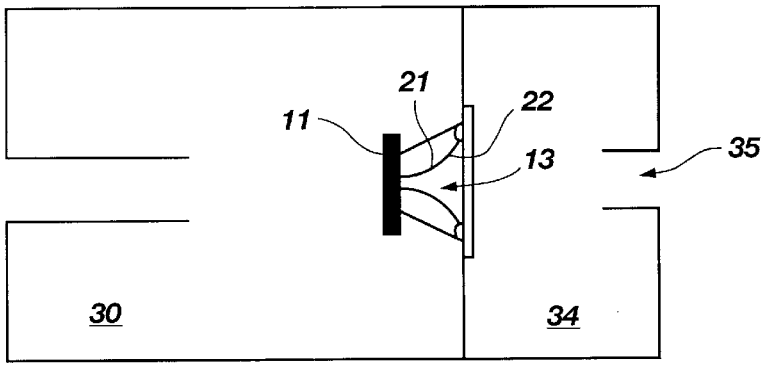
Fig. 2 (PRIOR ART)
FIG. 2 shows a prior art double reflex tuned bandpass enclosure.

FIG. 2 shows a prior art bandpass woofer system of the next level of complexity as shown in U.S. Pat. No. 4,549,631, granted to Bose. Main enclosure 10 containing sub enclosure volumes 30 and 34 with a passive acoustic energy radiator 35 venting sub enclosure volume 34 to the outside environment and passive acoustic energy radiator 36 venting sub enclosure volume 30 to the outside environment. Even though the second vent increases the maximum output of the system compared to that in FIG. 1, other than at the two vent tuning frequencies, the maximum acoustic output of this system is determined by the volume displacement capability of the electro-acoustic transducer itself Even at the vent tuning frequencies, the large signal output of this system cannot be maintained if the transducer cubic volume displacement is reduced; i.e. if the diameter or the excursion of the transducer is reduced.

Figure 3:
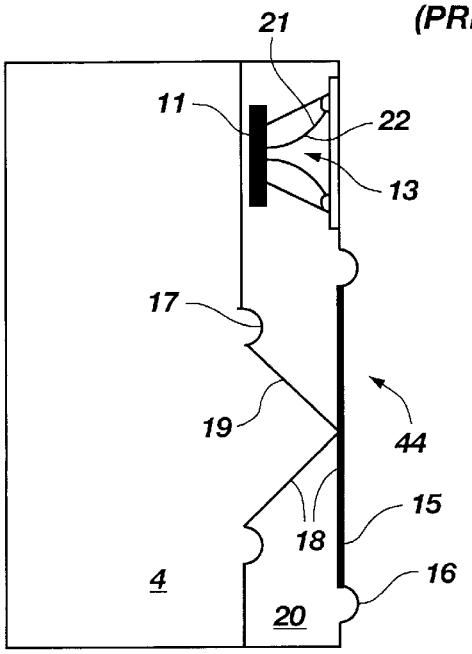
Fig. 3 (PRIOR ART)
FIG. 3 shows a prior art full range speaker with an augmented passive radiator as a vent substitute.

FIG. 3 shows the type of prior art system disclosed in U.S. Pat. No. 4,076,097, granted to Clarke, using an augmented passive radiator. Enclosure 10 contains sub enclosure volumes 4 and 20 and active transducer 11. Contained between the volumes is an augmented passive radiator 44 with two different diaphragm areas, a larger one 15 and a smaller one 19 mechanically coupled together and with active transducer 11 interacting with the difference area 18 of augmented passive radiator 44. As can be seen, the surface area 19 of augmented passive radiator 44 is isolated in auxiliary volume 4 and therefore cannot be coupled to the diaphragm 13 of transducer 11 and cannot contribute acoustic output to the system.

Figure 4:
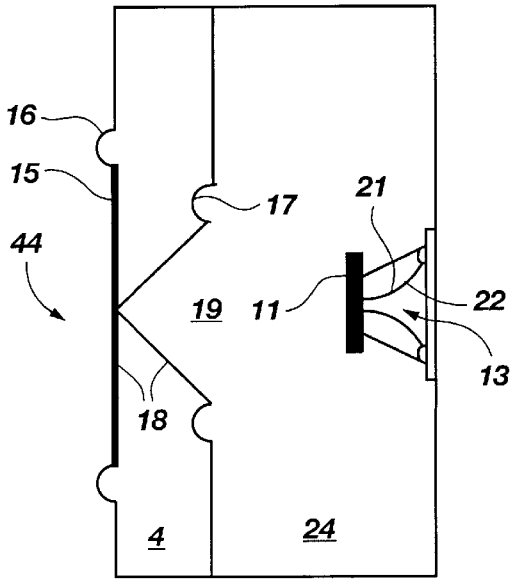
Fig. 4 (PRIOR ART)
FIG. 4 shows another prior art full range speaker with an augmented passive radiator as a vent substitute.

FIG. 4 shows the type of prior art system disclosed in U.S. Pat. No. 4,301,332, granted to Dusanek, that performs substantially the same as the one in FIG. 3 with the main difference being that transducer 11 is coupled to the small diaphragm area 19 of augmented passive radiator 44. Both of the systems in FIGS. 3 and 4 are full range systems and do not exhibit or teach an acoustic bandpass characteristic. Also, their use of the augmented passive radiator is implemented in a closed architecture with the third undriven, non-radiating diaphragm area (18 in FIG. 4) enclosed in an auxiliary volume 4 and cannot contribute to system output. This diaphragm area 18 is also isolated from the electro-acoustic transducer. This same limitation is exhibited in the device of FIG. 3 except it is the smaller diaphragm 19 of the augmented passive radiator 44 that is isolated in the auxiliary volume 4.

Figure 5A:
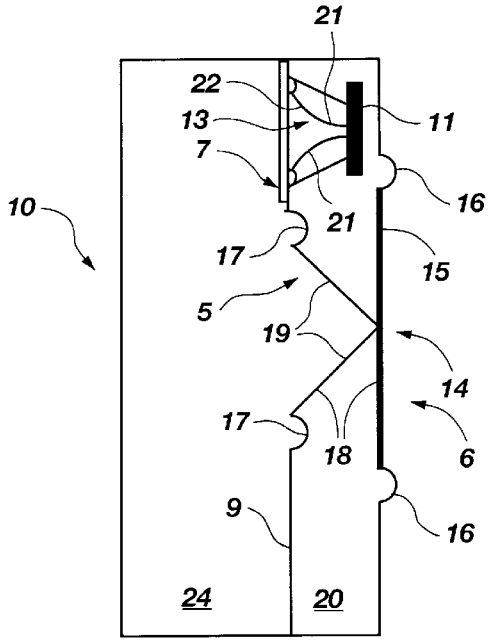
FIG. 5A shows a basic form of the invention in parallel interaction mode.

FIG. 5A shows a basic form of the invention. Shown is bandpass loudspeaker enclosure system 10 incorporating a total of two enclosures primary enclosure volume 20 and primary enclosure volume 24, with a dividing wall 9 positioned between the two primary enclosure volumes. An electro-acoustic transducer 11 is mounted in an opening 7 on dividing wall 9 and includes movable diaphragm 13 which has a surface area side 21 and a surface area side 22. Surface area side 21 of movable diaphragm 13 communicates into primary enclosure volume 20 and surface area side 22 of movable diaphragm 13 communicates into said primary enclosure volume 24.

There is a differential area passive radiator 14 that is comprised of primary diaphragm surface area 15 and two secondary diaphragm surface areas smaller in acoustic coupling area than primary diaphragm surface area 15. The secondary diaphragm surface areas include a unitary diaphragm surface area 19 and a differential diaphragm surface area 18. The primary diaphragm surface area 15 and the unitary diaphragm surface area 19 interconnect include a peripheral attachment means 16 and 17. The differential diaphragm surface area 18 is defined by the differential surface area established between primary diaphragm surface area peripheral attachment means 16 and unitary diaphragm surface area peripheral attachment means 17.

Unitary diaphragm surface area 19 of differential area passive radiator 14 is mounted by peripheral attachment means 17 in opening 5 between the two primary enclosure volumes 20 and 24. Surface area side 21 of electro-acoustic transducer 11 is pneumatically coupled through the primary enclosure volume 20 to unitary diaphragm surface area 19 of differential area passive radiator 14. Surface area side 22 of electro-acoustical transducer 11 is pneumatically coupled through enclosure volume 24 to differential diaphragm surface area 18 of differential area passive radiator 14. The primary diaphragm surface area 15 of differential area passive radiator 14 is mounted by peripheral attachment means 16 in opening 6 in primary enclosure volume 24. The primary diaphragm surface area 15 of differential area passive radiator 14 communicates from the opening in primary enclosure volume 24 to a region outside of the two primary enclosure volumes.

In this embodiment, particularly when the volume of primary enclosure volume 20 is smaller than that of primary enclosure volume 24, the active electro-acoustic transducer 11 and its diaphragm 13 form a bass reflex mode at a frequency near the upper range of the system by interacting with the differential area 18 of the differential area passive radiator 14. At all lower frequencies active electro-acoustic transducer 11 and differential area passive radiator 14 are firmly air coupled together and operate in phase. The active transducer drives the differential area passive radiator in a parallel relationship and therefore this is considered the parallel interaction version of the invention. The volume displacement of the system is magnified by the ratio of the diaphragm area of transducer 11 and the diaphragm area of differential diaphragm 18 of differential area passive radiator 14. If the diaphragm 13 is greater in area than differential surface area 18 then this ratio magnifies the displacement of transducer 11 to a greater displacement in differential area passive radiator 14. The acoustic volume displacement of the system is further magnified by the ratio of the diaphragm area of transducer 11 and the diaphragm area of diaphragm 15 of differential area passive radiator 14.

Figure 5B:
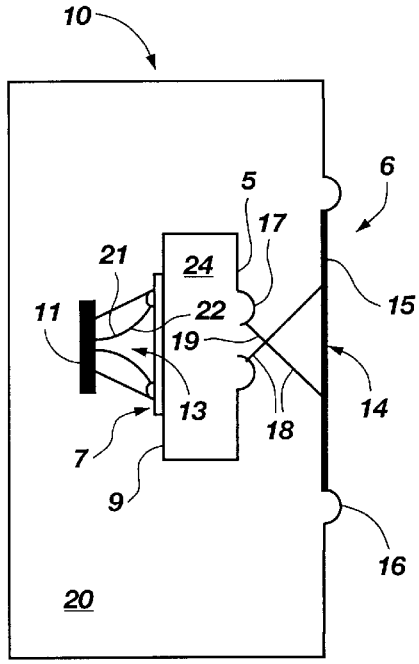
FIG. 5B shows a basic form of the invention in series interaction mode.

FIG. 5B shows another form of the invention that is considered the series interaction version of the invention. Shown is bandpass loudspeaker enclosure system 10 incorporating primary enclosure volume 20 and primary enclosure volume 24 with dividing wall 9 positioned between the two primary enclosure volumes. An electro-acoustic transducer 11 is mounted in opening 7 on dividing wall 9 and includes movable diaphragm 13 which has a surface area side 21 and a surface area side 22. Surface area side 21 of movable diaphragm 13 communicates into primary enclosure volume 20 and surface area side 22 of movable diaphragm 13 communicates into primary enclosure volume 24.

Included is differential area passive radiator 14 that is comprised of primary diaphragm surface area 15 and two secondary diaphragm surface areas smaller in acoustic coupling area than said primary diaphragm surface area 15. The secondary diaphragm surface areas include unitary diaphragm surface area 19 and differential diaphragm surface area 18. The primary diaphragm surface area 15 and unitary diaphragm surface area 19 interconnect and include peripheral attachment means 16 and 17. The differential diaphragm surface area 18 is defined by the differential surface area established between primary diaphragm surface area peripheral attachment means 16 and secondary diaphragm surface area peripheral attachment means 17.

The unitary diaphragm surface area 19 of the differential area passive radiator 14 is mounted by peripheral attachment means 17 in opening 5 between the two primary enclosure volumes 20 and 24. The surface area side 21 of the electro-acoustic transducer 11 is pneumatically coupled through primary enclosure volume 20 to unitary diaphragm surface area 19 of differential area passive radiator 14. The surface area side 22 of the electro-acoustical transducer 11 is pneumatically coupled through primary enclosure volume 24 to differential diaphragm surface area 18 of differential area passive radiator 14. The primary diaphragm surface area 15 of differential area passive radiator 14 is mounted by peripheral attachment means 16 in opening 6 in primary enclosure volume 24. The primary diaphragm surface area 15 of differential area passive radiator 14 communicates from the opening in primary enclosure volume 24 to a region outside of the two primary enclosure volumes.

In this embodiment, particularly when the volume of primary enclosure volume 24 is smaller than that of primary enclosure volume 20, the driving force of the active electro-acoustic transducer 11 and its diaphragm 13 interact to couple with the smaller diaphragm area 19 of the differential area passive radiator 14 and therefore at low frequencies active electro-acoustic transducer 11 and differential area passive radiator 14 operate in phase. The active transducer drives the differential area passive radiator in a serial relationship and therefore this is considered the series interaction version of the invention. The output of the active transducer 11 is magnified to substantially the same extent as the device in FIG. 5A assuming that the diaphragm area of differential diaphragm area 18 in FIG. 5A is the same as the diaphragm area of unitary diaphragm area 19 of FIG. 5B and the diaphragm area 13 is the same in both FIGS. 5A and 5B.

Figure 5C:
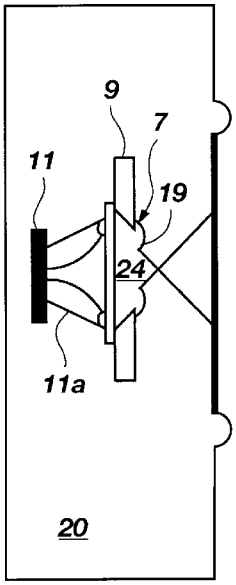
FIG. 5C shows another form of the invention with an additional chamber and vent.

FIG. 5C is operationally the same as the embodiment illustrated in FIG. 5B with the structural exception that the total volume of primary enclosure volume 24 is created by the opening 7 in dividing wall 9 and the volume trapped between electroacoustic transducer 11 and unitary diaphragm area 19. Electroacoustic transducer 11 and unitary diaphragm area 19 are mounted on each side of a single divider 9.

Figure 5D:
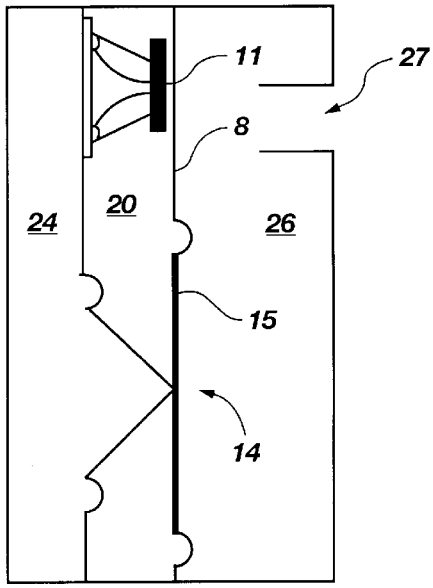

FIG. 5D is an enhanced version of the bandpass loudspeaker enclosure system of FIG. 5A further including an additional enclosure volume 26 sharing a boundary wall 8 with primary enclosure volume 20, for a total of three interior enclosure volumes. The primary diaphragm surface area 15 of said differential area passive radiator 14 has one side communicating through said boundary wall 8 into said additional enclosure volume 26. There is a passive acoustic energy radiator 27 acoustically coupling the interior of additional enclosure volume 26 to the external environment. The passive acoustic radiator has the characteristic of acoustic mass and can be selected from the group consisting of vents, ports, and suspended passive diaphragms and is shown here as an elongated port.

Any embodiments of the invention that use a form of passive acoustic energy radiator may borrow from the group that is known in the industry that include but are not limited to, vent openings, extended port tubes or suspended passive diaphragms. An augmented passive radiator which is essentially a differential area passive radiator or two suspended passive diaphragms connected back to back with an auxiliary chamber may also be used as the passive acoustic energy radiator.

Figure 6A:
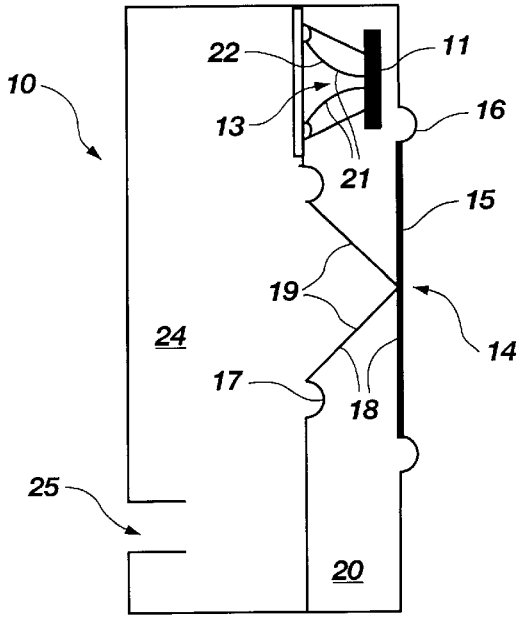
FIG. 6A shows a basic form of the invention with a vent.

FIG. 6A is the bandpass loudspeaker enclosure system of FIG. 5A further including a passive acoustic energy radiator 25, expressed here as an elongated port, communicating from the interior to the outside of primary enclosure volume 24. With this embodiment the open architecture of the differential area passive radiator 14 contributes significant increases in output. At the lowest frequencies reproduced by the system the open, shared volume 24 allows the surface area 22 of diaphragm 13 of transducer 11 to sum together with surface area 19 of differential area passive radiator 14 to deliver very high acoustic output through passive acoustic energy radiator 25. FIG. 6B is the bandpass loudspeaker enclosure system of FIG. 5B further including a passive acoustic energy radiator 25, expressed here as an elongated port, communicating from the interior to the exterior of primary enclosure volume 20. With this embodiment the open architecture of the differential area passive radiator 14 contributes significant increases in output. At the lowest frequencies reproduced by the system the open, shared volume 20 allows the surface area 21 of diaphragm 13 of transducer 11 to sum together with differential diaphragm surface area 18 of differential area passive radiator 14 to deliver very high acoustic output through passive acoustic energy radiator 25. An example of the parameters for a system of FIG. 6B reduced to practice:

Specifications for a system as shown in FIG. 6B

- Electro-acoustic transducer 11 parameters
- Diaphragm 13 diameter: 6.5"
- Free air resonance: 45 Hz
- Moving mass: 0.03 kg
- DC resistance: 6.2 ohms
- Qes: 0.27
- Qms: 6.5

Passive elements

Figure 6C:
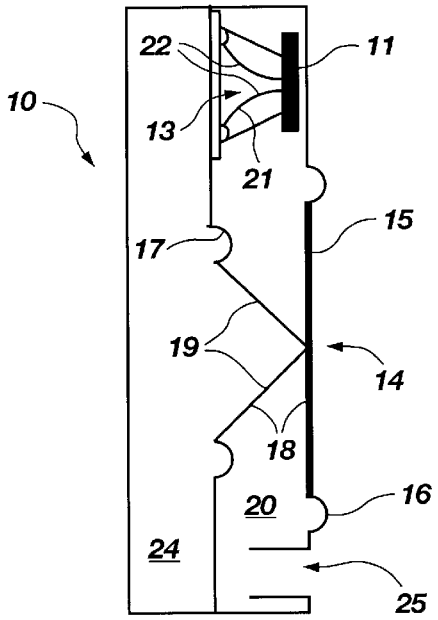
FIG. 6C shows another construction form of the invention with a vent.
Figure 6B:
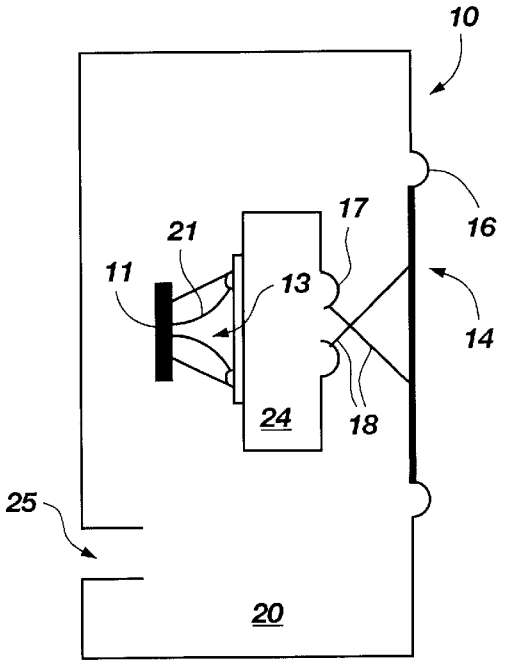
FIG. 6B shows another basic form of the invention with a vent.

- Differential Area Passive Radiator unitary diaphragm diameter 19: 6.5"
- Differential Area Passive Radiator Primary diaphragm diameter 15: 8.0"
- Primary Enclosure Volume 20: 2670 cubic inches
- Primary Enclosure Volume 24: 130 cubic inches
- Diameter of port 25: 4"
- Length of port 25: 15"
- Differential Area Passive Radiator 14 mass: 0.070 Kg
- Differential Area Passive Radiator 14 free air resonance: 40 Hz FIG. 6C shows an alternate form of construction that operates the same as the embodiment shown in FIG. 6B. The primary difference is that passive acoustic radiator 25 has been moved from primary enclosure volume 24 to primary enclosure volume 20. To make this alignment function the same as that shown in FIG. 6B the actual volume dimensions of primary enclosure volumes 20 and 24 are exchanged.

Figure 6D:
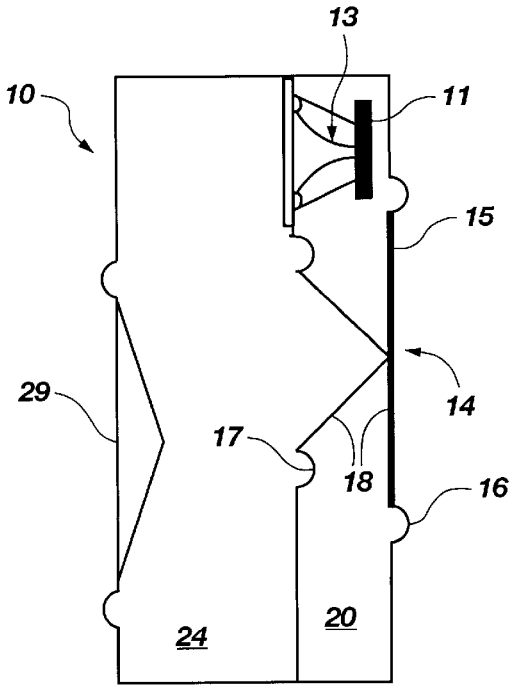
FIG. 6D shows a basic form of the invention with a passive radiator as a vent substitute.

FIG. 6D shows a variation of the embodiment illustrated in FIG. 6A that substitutes a passive suspended diaphragm 29 as the passive acoustic energy radiator in place of the extended port 25 of FIG. 6A.

Figure 7A:
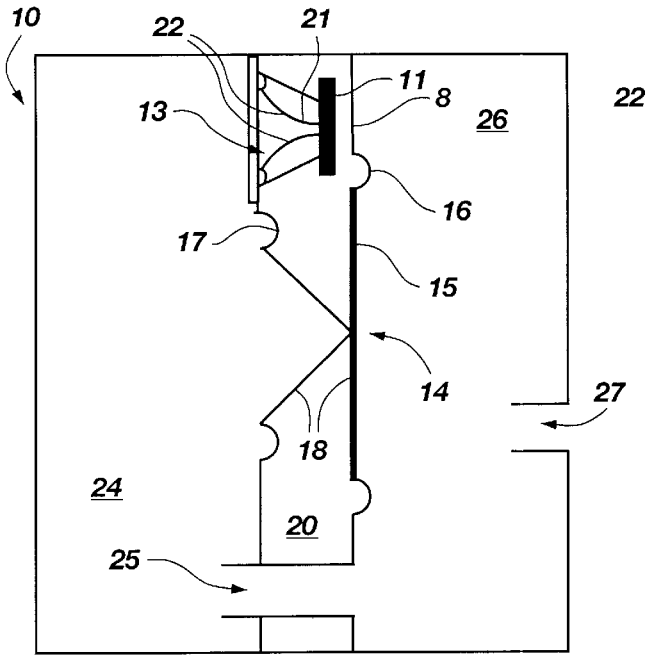
FIG. 7A shows the invention of FIG. 6B with an additional chamber and additional vent.

FIG. 7A is an enhanced version of the bandpass loudspeaker enclosure system of FIG. 6A further including an additional enclosure volume 26. The additional enclosure volume shares boundary wall 8 with primary enclosure volume 20. The passive acoustic energy radiator 25 in this case is communicating from the interior of primary enclosure volume 24 into additional enclosure volume 26. The primary diaphragm surface area 15 of differential area passive radiator 14 has one side communicating through boundary wall 8 into additional enclosure volume 26. A second passive acoustic energy radiator 27 acoustically couples the inside of additional enclosure volume 26 to the external environment.

Figure 7C:
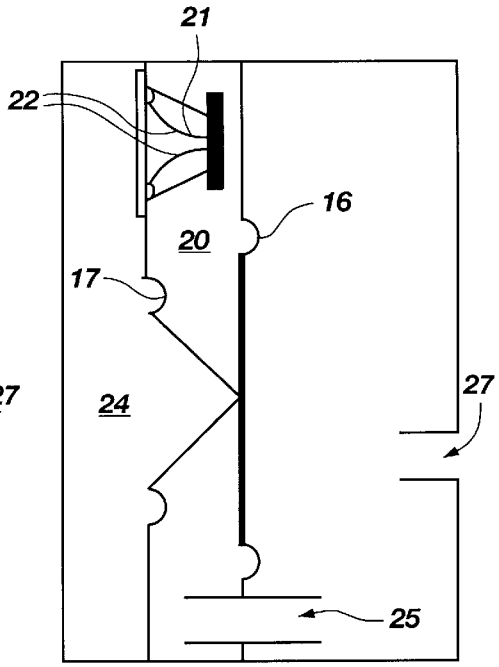
FIG. 7C shows the invention with another alternative construction to the system in FIG. 7A.
Figure 7B:
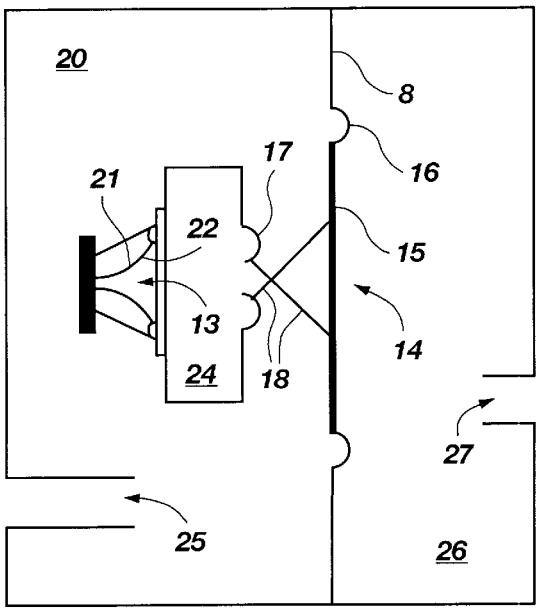
FIG. 7B shows the invention with an alternative construction to the system in FIG. 7*a*.

FIG. 7B is an enhanced version of the bandpass loudspeaker enclosure system of FIG. 6B further including an additional enclosure volume 26. The additional enclosure volume 26 sharing a boundary wall 8 with primary enclosure volume 20. The primary diaphragm surface area 15 of differential area passive radiator 14 has one side communicating through boundary wall 8 into additional enclosure volume 26. A second passive acoustic energy radiator 27 acoustically couples the interior of additional enclosure volume 26 to the external environment.

FIG. 7C is an enhanced version of the bandpass loudspeaker enclosure system of FIG. 6C further including an additional enclosure volume 26. The additional enclosure volume 26 shares a boundary wall 8 with primary enclosure volume 20. The passive acoustic energy radiator 25 in this case is communicating from the interior of primary enclosure volume 20 into additional enclosure volume 26. The primary diaphragm surface area 15 of differential area passive radiator 14 has one side communicating through boundary wall 8 into additional enclosure volume 26. A second passive acoustic energy radiator 27 acoustically couples the interior of additional enclosure volume 26 to the external environment.

Figure 7D:
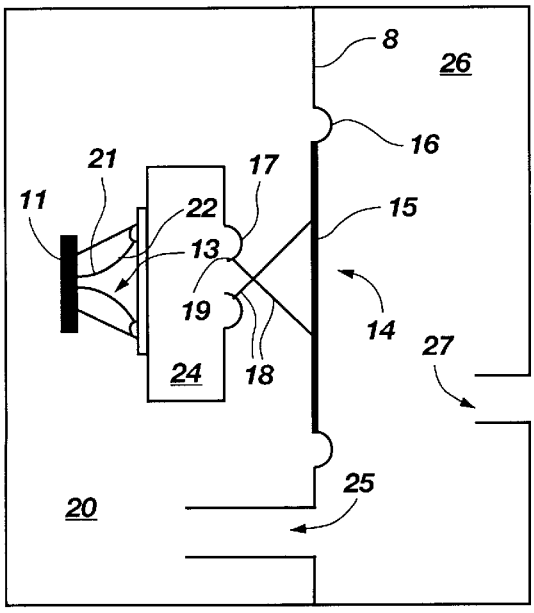
FIG. 7D shows the invention with another alternative construction to the system in FIG. 7A.

FIG. 7D is a variation of the bandpass loudspeaker enclosure system of FIG. 7B. The primary difference is that passive acoustic energy radiator 25 in this case is communicating from the interior of primary enclosure volume 24 into additional enclosure volume 26.

Figure 16:
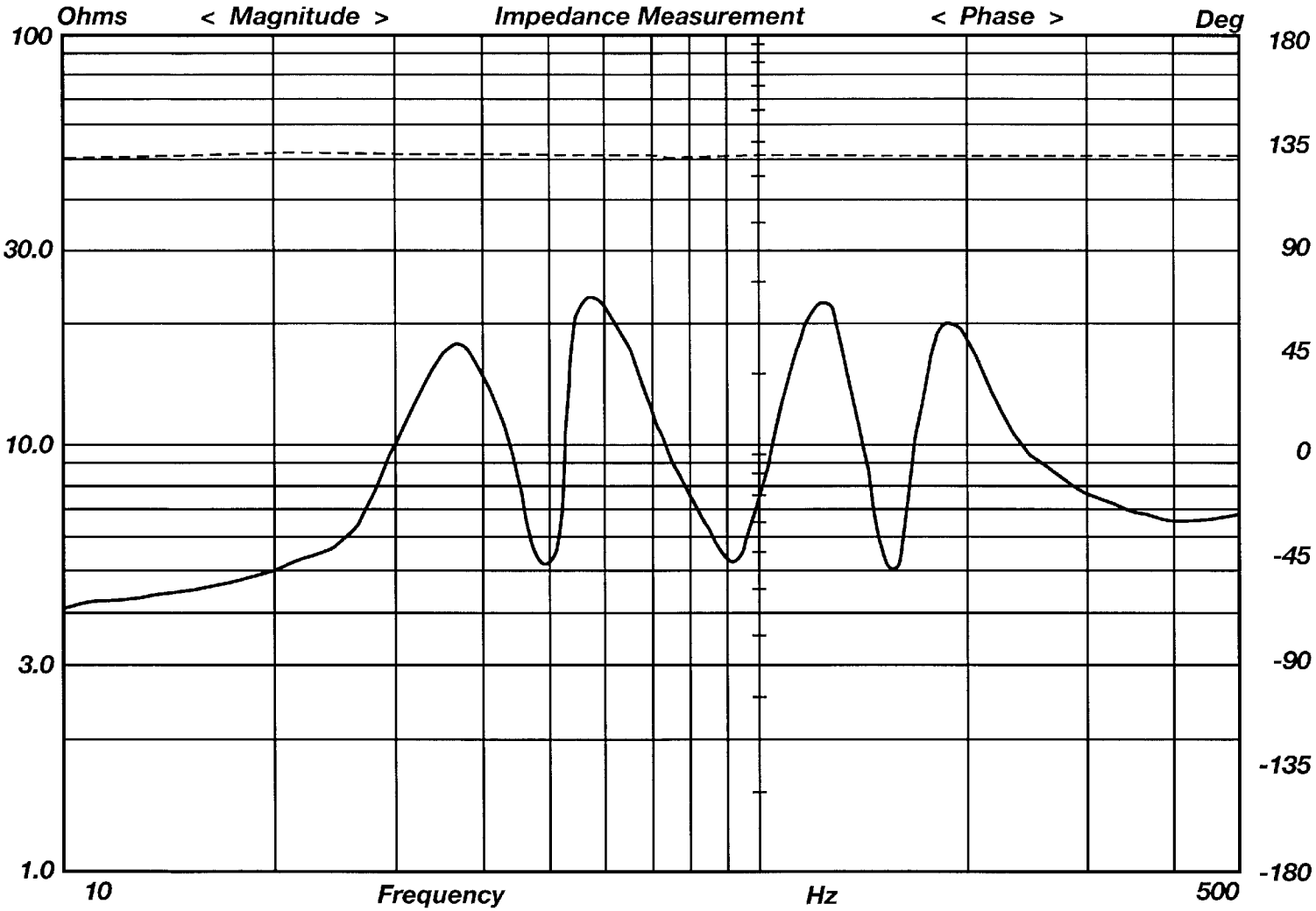
FIG. 16 is an impedance graph of one embodiment of the invention.

To get a further understanding of a preferred embodiment of the structure shown in FIG. 7D see the impedance graph of FIG. 16 along with the following description.

Starting at the high frequency, one mode includes a lowpass—6 dB point which in one alignment type substantially corresponds to the highest frequency impedance maximum at 195 Hz which is dominated by the interaction of the mass of diaphragm 13 of the electro-acoustic transducer 11 interacting with the stiffness of the air in the smaller of the two primary enclosure volumes 24. Moving down in frequency, the next mode is the impedance minimum at 161 Hz which is due to the highest reflex mode which is dominated by the interaction of the mass of the differential area passive radiator diaphragms 14 and the stiffness of the air volume 24 that is coupling it to the diaphragm active electro-acoustic transducer 13. This also corresponds to an excursion minimum for the active transducer diaphragm 13.

Moving down in frequency, the next mode is shown in the impedance peak at 132 Hz which is dominated by the interaction of the combined mass of the active transducer diaphragm 13 and the differential area passive radiator 14 with the stiffness of the additional enclosure volume 26. Going further down in frequency the impedance minimum at 92 Hz is derived from the mass of the port 27 and the stiffness of the air in the additional enclosure volume 26. This also corresponds to a diaphragm excursion minimum for diaphragm 13 of the active transducer 11 and the differential area passive radiator 14. Going down in frequency the next mode is shown in the impedance peak at 58 Hz which is dominated by the combined mass and areas of the active transducer diaphragm 13 and the differential area passive radiator 14 interacting with the stiffness of air volume of primary enclosure volume 20.

Going further down in frequency, an impedance minimum is reached at 50 Hz which is caused predominantly by the mass of the passive acoustic energy radiator 25, drawn here as a port, interacting with the stiffness of the air in sub-enclosure volume 20. At this frequency this volume of air is being driven by the in-phase motion of the active transducer diaphragm 13 and the differential area 18 of the differential area passive radiator 14. The frequency also corresponds to a diaphragm excursion minimum for transducer 11 and differential area passive radiator 14. This particular tuning frequency is further influenced by the acoustic masses of the air volume 26 and port 27. This interaction reduces the acoustic mass requirement for port 25 and therefore allows the construction of a smaller or less lossy port. As the frequency is lowered the last mode of significance is illustrated by the impedance peak at 38 Hz which is generated from all the masses being coupled together from diaphragms 13 and 14 and air masses 26 and 24 and 20 and acoustic port masses 25 and 27 all interacting with the summed stiffness of surrounds 23, 17, and 16.

An example of the parameters for a system of FIG. 7D reduced to practice.

Specifications for a system as shown in FIG. 7D

- Electro-acoustic transducer 11 parameters
- Diaphragm 13 diameter: 5"
- Free air resonance: 60 Hz
- Moving mass: 0.025 kg
- DC resistance: 6.2 ohms
- Qes: 0.30
- Qms: 7.0

Passive elements

- Differential Area Passive Radiator unitary diaphragm 19 diameter: 4.5"
- Differential Area Passive Radiator primary diaphragm 15 diameter: 6.7"
- Primary Enclosure Volume 20: 870 cubic inches
- Primary Enclosure Volume 24: 60 cubic inches
- Additional Enclosure Volume 26: 970 cubic inches
- Diameter of port 25: 2.5"
- Length of port 25: 6.5" Model
- Diameter of port 27: 4"
- Length of port 27: 4.75" Model
- Differential Area Passive Radiator 14 mass: 0.020 Kg
- Differential Area Passive Radiator 14 free air resonance: 65 Hz Since FIG. 7D substantially represents the invention in one of its more complex forms one skilled in the art can understand all of the simpler forms of the invention by removing elements and their interactions from the preceding description. The embodiments of FIGS. 7A, 7B, 7C and 7D all have the further advantages of reducing the excursions of all of the moving diaphragms, greater bandpass bandwidth for an equivalent efficiency and enclosure volume, steeper lowpass acoustic filter characteristic and acoustically filtered distortion, therefore reduced distortion output.

Figure 8A:
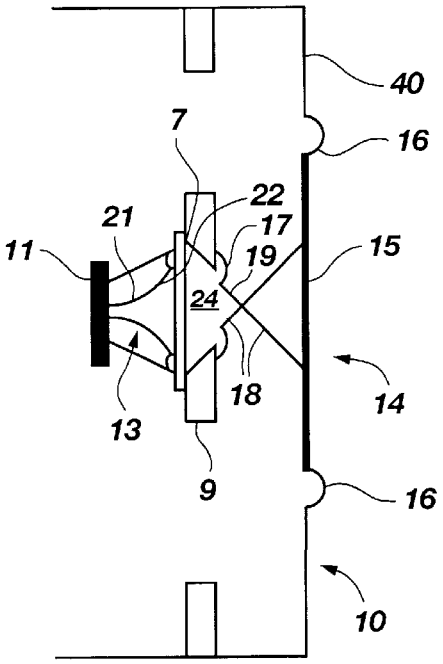
FIG. 8A shows an open dipole version of the invention in series coupling mode.

FIG. 8A illustrates an open dipole version of the bandpass loudspeaker enclosure system invention. Shown is bandpass loudspeaker enclosure system 10 incorporating a primary enclosure volume 24, an electro-acoustic transducer 11 mounted on an opening 7 on bounding wall 9 of primary enclosure volume 24 and includes movable diaphragm 13 which has a surface area side 21 and a surface area side 22. There is a differential area passive radiator that includes a primary diaphragm surface area 15 and two secondary diaphragm surface areas smaller in acoustic coupling area than said primary diaphragm surface area 15. Those secondary diaphragm surface areas including a unitary diaphragm surface area 19 and a differential diaphragm surface area 18.

The primary diaphragm surface area 15 and the unitary diaphragm surface area interconnect and include peripheral attachment means 16 and 17. The differential diaphragm surface area 18 is defined by the differential surface area established between said primary diaphragm surface area peripheral attachment means 16 and unitary diaphragm surface area peripheral attachment means 17. The unitary diaphragm surface area 19 of the differential area passive radiator is mounted by peripheral attachment means 17 in opening 7 in primary enclosure volume 24. One surface area side 22 of the electro-acoustic transducer movable diaphragm 13 is pneumatically coupled through the primary enclosure volume 24 to unitary diaphragm surface area 19 of the differential area passive radiator 14. A supporting structure 40 is connected to said primary enclosure volume 24, to which peripheral attachment means 16 of primary diaphragm surface area 15 of differential area passive radiator 14 is attached.

Figure 8C:
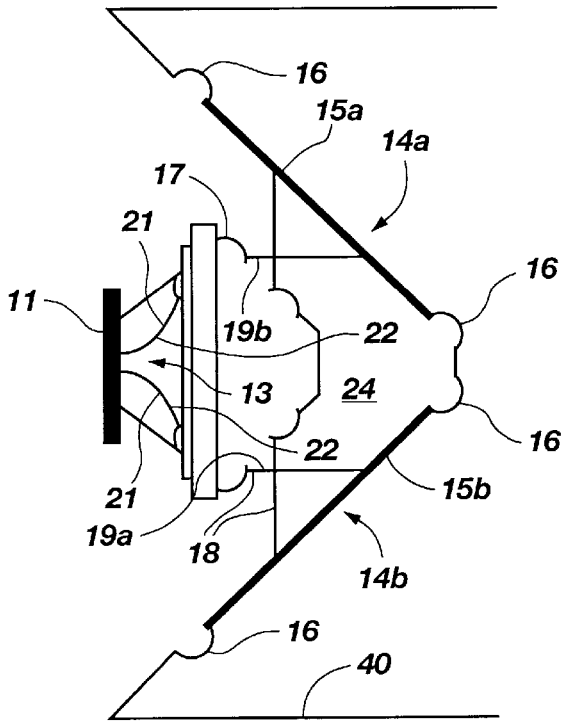
FIG. 8C shows another dipolar version of the invention with two differential area passive radiators.
Figure 8B:
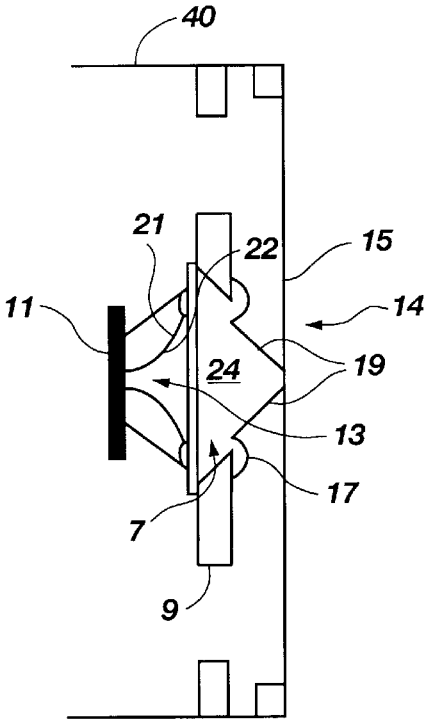
FIG. 8B shows another dipolar version of the invention.

FIG. 8B is essentially the same as FIG. 8A except that large, primary diaphragm area 15 of the differential area passive radiator 14 is shown to be composed of a thin film type diaphragm material such as polyester or polypropylene.

FIG. 8C shows the invention embodiment of 8A with a single electro-acoustic transducer 11 pneumatically coupled to two differential area passive radiators 14*a* and 14*b*.

Figure 8D:
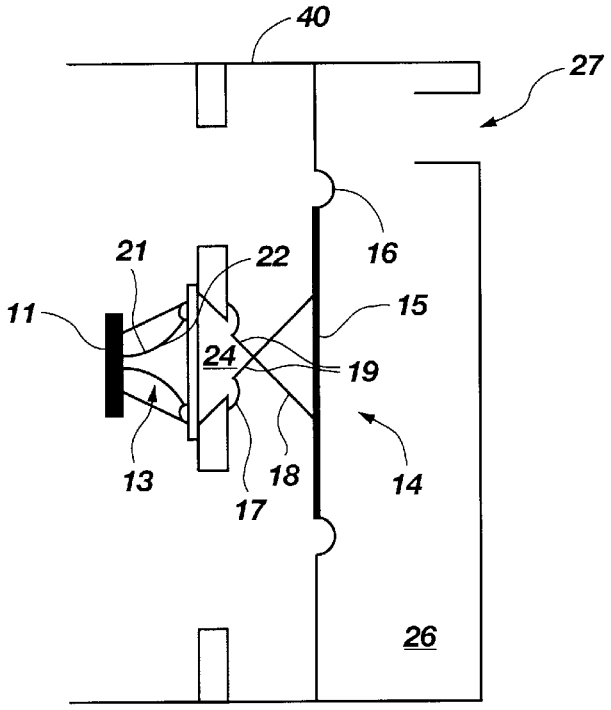
FIG. 8D shows a dipolar version of the invention with an additional chamber and vent.

FIG. 8D is an enhanced version of the embodiment illustrated in FIG. 8A with an additional enclosure volume 26 attached to one wall of the outside of the main enclosure mounting structure 40. The primary diaphragm area 15 of the differential area passive radiator 14 communicates into the additional enclosure volume. A passive acoustic energy radiator 27, is shown as a port, acoustically coupling the interior of said additional enclosure 26 to the external environment.

Figure 8E:
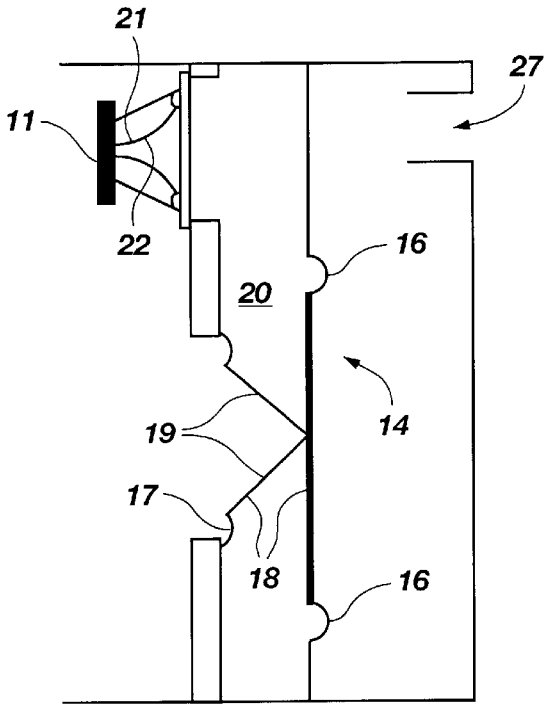
FIG. 8E shows another dipolar version of the invention with an additional chamber and vent.

FIG. 8E is a parallel version of FIG. 8D with the main difference being that transducer 11 is pneumatically coupled through primary enclosure volume 20 to the differential surface area 18 of differential area passive radiator 14.

Figure 8F:
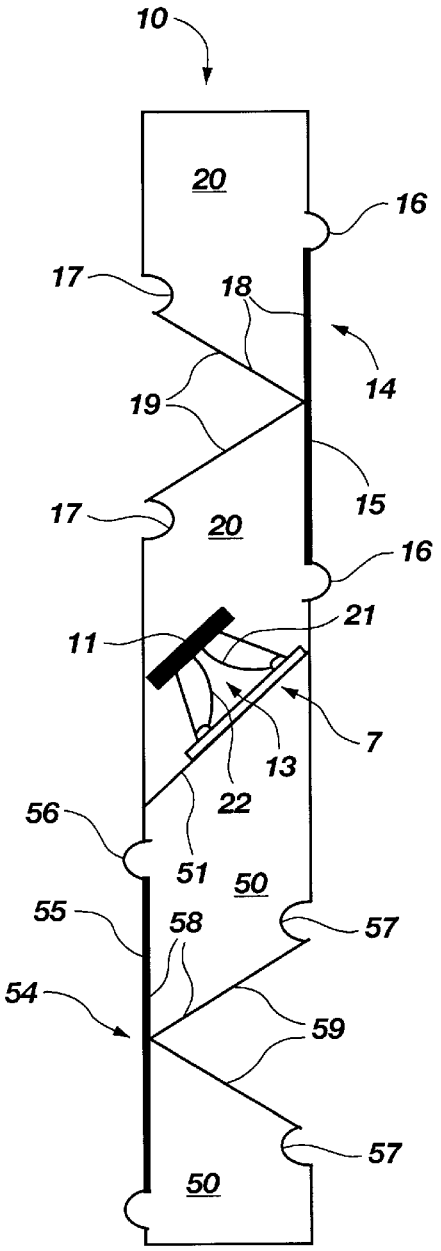
FIG. 8F shows a push pull dipole version of the invention with two differential area passive radiators.

FIG. 8F shows a bandpass loudspeaker enclosure system 10 incorporating a primary enclosure volume 20 and primary enclosure volume 50. A dividing wall 51 is positioned between the two primary enclosure volumes. An electro-acoustic transducer 11 is mounted on opening 7 on dividing wall 51 and includes movable diaphragm 13 which has surface area side 21 and surface area side 22. The surface area side 21 of movable diaphragm 13 communicates into primary enclosure volume 20 and surface area side 22 of movable diaphragm 13 communicates into primary enclosure volume 50. There is a first differential area passive radiator 14 and a second differential area passive radiator 54 including primary diaphragm surface areas 15 and 55 and two secondary diaphragm surface areas smaller in acoustic coupling area than the primary diaphragm surface area. The secondary diaphragm surface areas include unitary diaphragm surface areas 19 and 59 and differential diaphragm surface areas 18 and 58. The primary diaphragm surface area and unitary diaphragm surface areas interconnect and include peripheral attachment means 16 and 17 and 56 and 57.

The differential diaphragm surface area 18 is defined by the differential surface area established between primary diaphragm surface area peripheral attachment means 16 and unitary diaphragm surface area peripheral attachment means 17 for the first differential area passive radiator 14, and differential diaphragm surface area 58 is defined by the differential surface area established between primary diaphragm surface area peripheral attachment means 56 and unitary diaphragm surface area peripheral attachment means 57 for the second differential area passive radiator 54. The surface area side 21 of the electro-acoustic transducer 11 is pneumatically coupled through primary enclosure volume 20 to differential diaphragm surface area 18 of first differential area passive radiator 14. The surface area side 22 of the electro-acoustical transducer 11 is pneumatically coupled through primary enclosure volume 50 to differential diaphragm surface area 58 of the second differential area passive radiator 54. The unitary surface areas 19 and 59 of first and second differential area passive radiators 14 and 54 communicate outside of primary enclosure volumes 20 and 50. The primary diaphragm surface areas 15 and 55 of the first and second differential area passive radiators 14 and 54 each have one side communicating to a region outside of primary enclosure volumes 20 and 50.

Figure 9A:
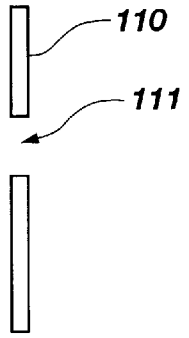
FIG. 9A shows a passive acoustic radiator illustrated as a vent opening.
Figure 9B:
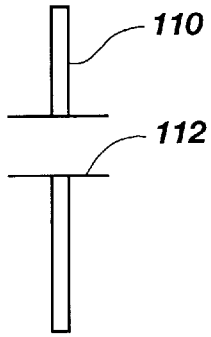
FIG. 9B shows a passive acoustic radiator illustrated as an extended port.
Figure 9C:
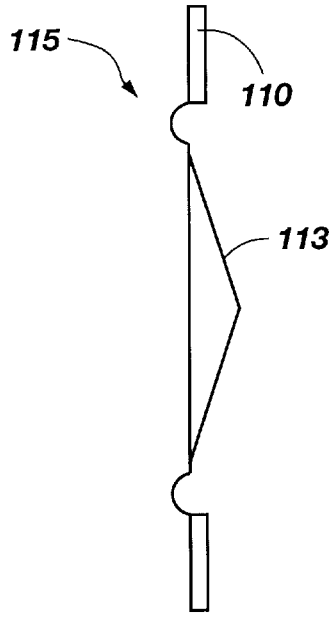
FIG. 9C shows a passive acoustic radiator illustrated as a suspended passive diaphragm.

FIG. 9A shows an opening 111 through a wall or partition 110 that represents prior art passive acoustic radiator called a vent. FIG. 9B shows an elongated pipe 112 mounted through a wall or partition 110 that represents prior art passive acoustic radiator called a port. FIG. 9C shows an opening 115 in a wall or partition 110 that has a passive suspended radiator 113 mounted in the opening 115 and represents prior art passive acoustic radiator called a passive radiator or passive suspended radiator.

Figure 9D:
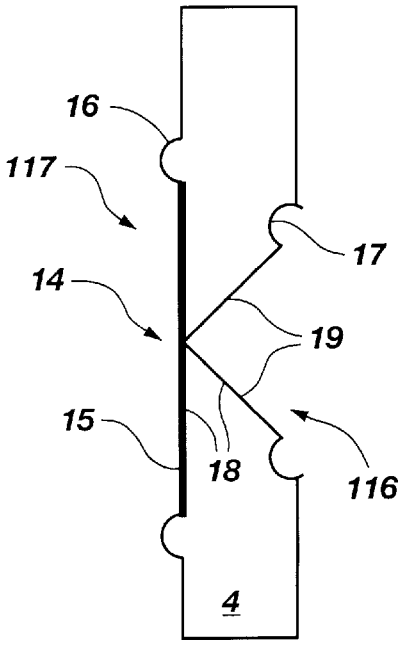
FIG. 9D shows a passive acoustic radiator illustrated as an augmented passive radiator.
Figure 9E:
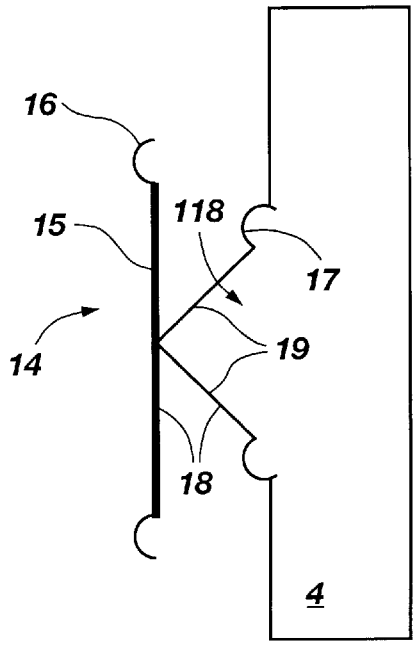
FIG. 9E shows a passive acoustic radiator illustrated as a second type of augmented passive radiator.

FIG. 9D shows an auxiliary enclosure volume 4 with a differential area passive radiator 14 mounted in two different openings 116 and 117 in the auxiliary enclosure volume 4. This represents a parallel augmented passive radiator. FIG. 9E shows an auxiliary enclosure volume 4 with a differential area passive radiator 14 mounted in an opening 118 in the auxiliary enclosure volume. This represents a series augmented passive radiator.

Figure 10A:
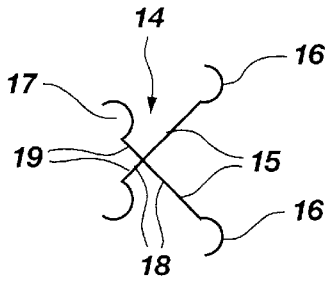
FIG. 10A illustrates a construction of the differential area passive radiator.

FIG. 10A shows a construction of a differential area passive radiator 14 that is comprised of primary diaphragm surface area 15 and two secondary diaphragm surface areas 18 and 19 smaller in acoustic coupling area than primary diaphragm surface area 15. The secondary diaphragm surface areas include a unitary diaphragm surface area 19 and a differential diaphragm surface area 18. The primary diaphragm surface area 15 and the unitary diaphragm surface area 19 interconnect and each include peripheral attachment means 16 and 17. The differential diaphragm surface area 18 is defined by the differential surface area established between the primary diaphragm surface area peripheral attachment means 16 and the unitary diaphragm surface area peripheral attachment means 17.

Figure 10B:
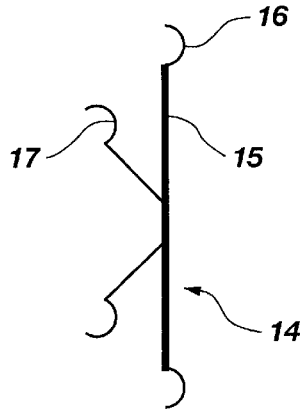
FIG. 10B illustrates a construction variation of the differential area passive radiator.
Figure 10C:
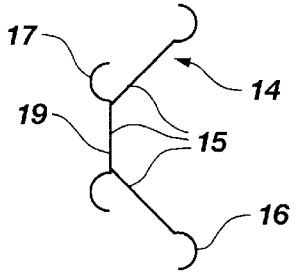
FIG. 10C illustrates another construction variation of the differential area passive radiator.
Figure 10D:
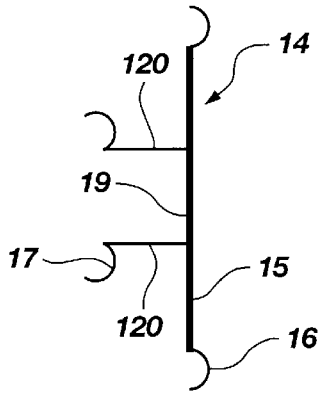
FIG. 10D illustrates another construction variation of the differential area passive radiator.

FIG. 10B shows a construction of a differential area passive radiator 14, where the large primary diaphragm area 15 is expressed in a flat piston form. This may be of a skinned honeycomb construction for rigidity. FIG. 10C shows a construction of a differential area passive radiator 14, where the small diaphragm area 19 is expressed as a sealed off portion of the smaller end of a large loudspeaker cone diaphragm 15. FIG. 10D shows a version of the differential area passive radiator 14, with the large primary diaphragm area 15 is substantially the same as FIG. 10B but with the small unitary diaphragm area 19 captured by open cylinder 120.

Figure 10E:
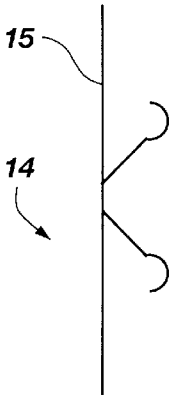
FIG. 10E illustrates another construction variation of the differential area passive radiator.
Figure 10F:
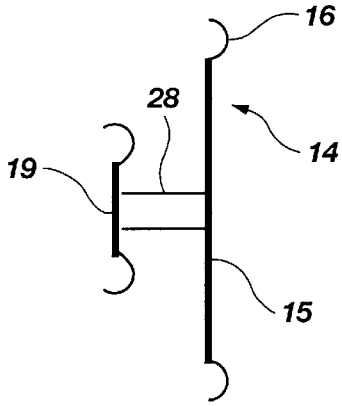
FIG. 10F illustrates another construction variation of the differential area passive radiator.

FIG. 10E shows a version of the differential area passive radiator 14, with the large primary diaphragm area 15 expressed as a thin film diaphragm such as polyester, polypropylene or kapton film. FIG. 10F shows a version of the differential area passive radiator 14 with the small unitary diaphragm area 19 also being expressed in a flat piston form, the large primary diaphragm 15 expressed as a flat piston form and mechanical connection means 28 joining the two diaphragms together. These diaphragms may be of a skinned honeycomb construction for rigidity.

Figure 10G:
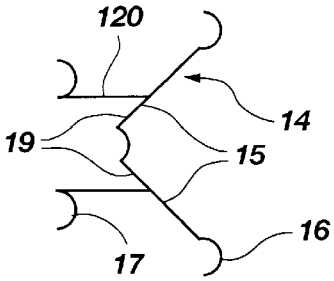
FIG. 10G illustrates another construction variation of the differential area passive radiator.
Figure 10H:
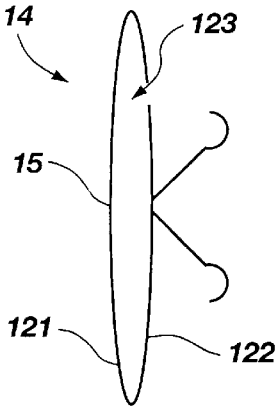
FIG. 10H illustrates another construction variation of the differential area passive radiator.

FIG. 10G shows a version of the differential area passive radiator 14, with the large primary diaphragm area 15 is substantially the same as FIG. 10A but with the small diaphragm area 19 expressed as an open cylinder. FIG. 10H shows a version of the differential area passive radiator 14, similar to that in FIG. 10E with the large diaphragm area 15 using at least two thin films 121 and 122 in parallel and being forcibly separated. The separation may be facilitated by a volume of air 123 trapped inside and sealed off from the outside or by other filler material or structural means.

Figure 11A:
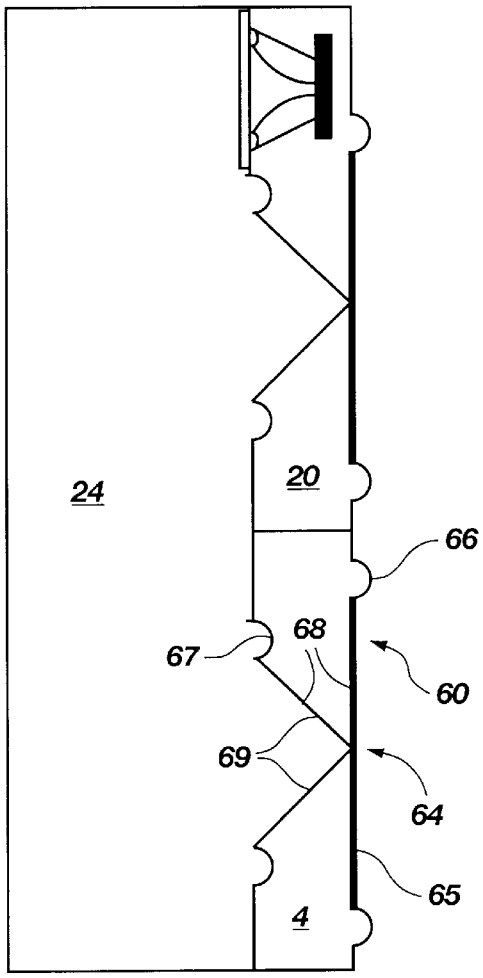
FIG. 11A depicts the invention of FIG. 6A with an augmented passive acoustic radiator.

FIG. 11A is the bandpass loudspeaker enclosure system of FIG. 6D except substituting augmented passive radiator 60, consisting of additional differential area passive radiator 64 and auxiliary enclosure volume 4, in place of suspended passive radiator 29 of FIG. 6D. This system includes an auxiliary enclosure volume 4 and one additional differential area passive radiator 64 which includes a primary diaphragm surface area 65 and two secondary diaphragm surface areas smaller in acoustic coupling area than said primary diaphragm surface area. The secondary diaphragm surface areas including a unitary diaphragm surface area 69 and a differential diaphragm surface area 68. The primary diaphragm surface area 65 and the unitary diaphragm surface area 69 interconnect and include peripheral attachment means 66 and 67.

The differential diaphragm surface area 68 is defined by the differential surface area established between the primary diaphragm surface area peripheral attachment means 66 and the secondary diaphragm surface area peripheral attachment means 67. The differential diaphragm surface area 68 of the additional differential area passive radiator 64 communicates into the auxiliary enclosure volume 4. The unitary diaphragm surface area of additional differential area passive radiator 64 communicates into primary enclosure volume 24. One side of primary diaphragm surface area 65 of the additional differential area passive radiator communicates to a region outside of auxiliary enclosure volume 4, primary enclosure volume 20 and primary enclosure volume 24.

Figure 11B:
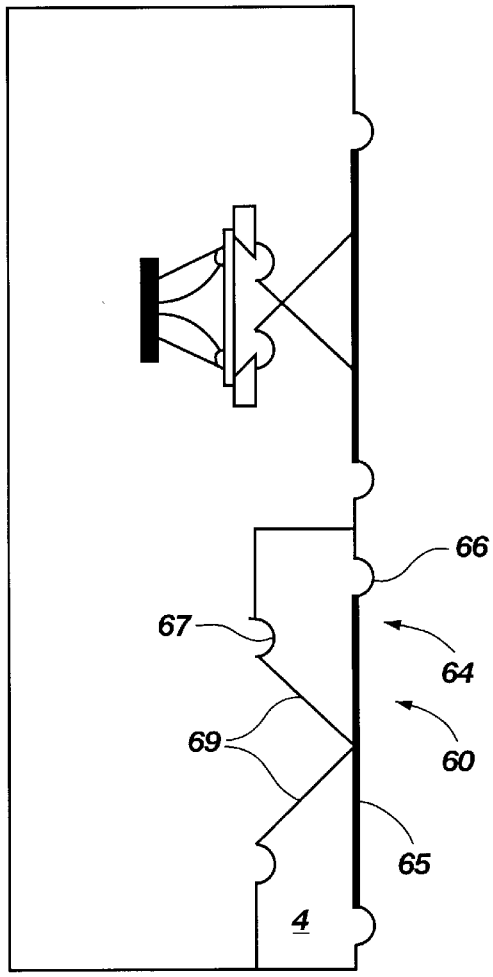
FIG. 11B shows a functional equivalent to FIG. 11A but of a different configuration.

FIG. 11B is the bandpass loudspeaker enclosure system of FIG. 5C further including a passive acoustic radiator expressed herein as augmented passive radiator 60 consisting of additional differential area passive radiator 64 and auxiliary enclosure volume 4. This system includes an auxiliary enclosure volume 4 and one additional differential area passive radiator 64 which includes primary diaphragm surface area 65 and two secondary diaphragm surface areas smaller in acoustic coupling area than said primary diaphragm surface area. The secondary diaphragm surface areas including unitary diaphragm surface area 69 and differential diaphragm surface area 68. Primary diaphragm surface area 65 and unitary diaphragm surface area 69 interconnect and include a peripheral attachment means 66 and 67.

The differential diaphragm surface area 68 is defined by the differential surface area established between the primary diaphragm surface area peripheral attachment means 66 and secondary diaphragm surface area peripheral attachment means 67. Differential diaphragm surface area 68 of additional differential area passive radiator 64 communicates into auxiliary enclosure volume 4. Unitary diaphragm surface area of the additional differential area passive radiator 64 communicates into primary enclosure volume 20. Primary diaphragm surface area 65 of additional differential area passive radiator 64 communicates to a region outside of auxiliary enclosure volume 4, primary enclosure volume 20 and primary enclosure volume 24.

Figure 11C:
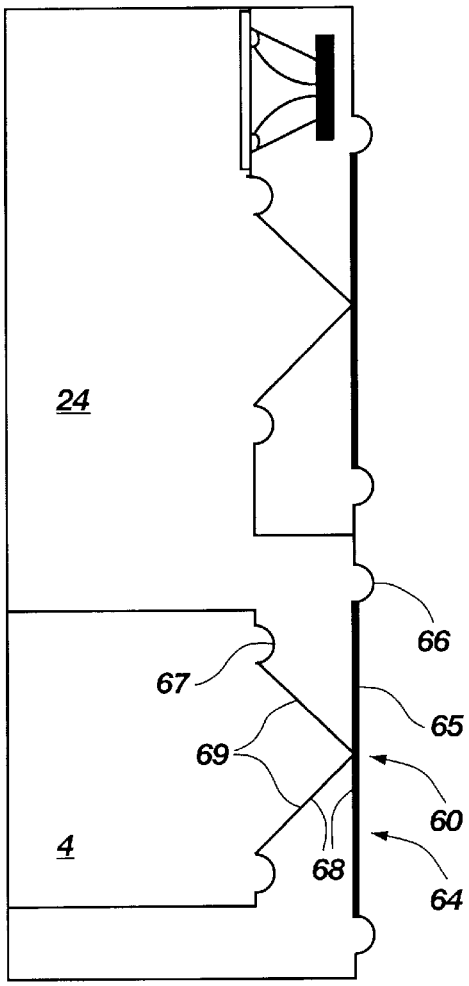
FIG. 11C shows a functional equivalent to FIG. 11A but of a different configuration.

FIG. 11C is the bandpass loudspeaker enclosure system of FIG. 6D except for the substitution of augmented passive radiator 60, consisting of additional differential area passive radiator 64 and auxiliary enclosure volume 4, in place of suspended passive radiator 29 of FIG. 6D. This system includes auxiliary enclosure volume 4 and one additional differential area passive radiator 64 which includes a primary diaphragm surface area 65 and two secondary diaphragm surface areas smaller in acoustic coupling area than said primary diaphragm surface area. The secondary diaphragm surface areas including a unitary diaphragm surface area 69 and differential diaphragm surface area 68. Primary diaphragm surface area 65 and unitary diaphragm surface area 69 interconnect and include peripheral attachment means 66 and 67.

The differential diaphragm surface area 68 is defined by the differential surface area established between the primary diaphragm surface area peripheral attachment means 66 and the secondary diaphragm surface area peripheral attachment means 67. The unitary diaphragm surface area 69 of the additional differential area passive radiator 64 communicates into the auxiliary enclosure volume 4. The differential diaphragm surface area 68 of additional differential area passive radiator 64 communicates into primary enclosure volume 24. One side of primary diaphragm surface area 65 of the additional differential area passive radiator 64 communicates to a region outside of auxiliary enclosure volume 4, primary enclosure volume 20 and primary enclosure volume 24.

Figure 11D:
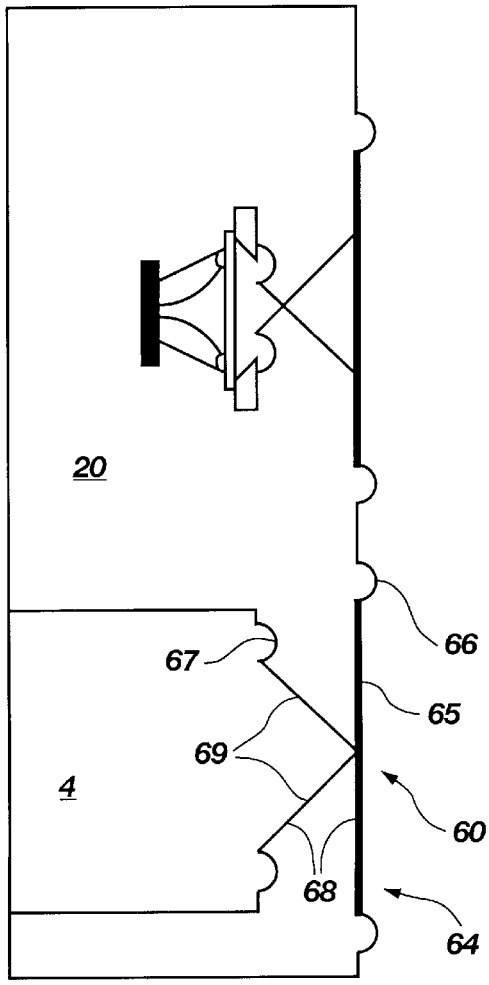
FIG. 11D shows a functional equivalent to FIG. 11A but of a different configuration.

FIG. 11D is the bandpass loudspeaker enclosure system of FIG. 5C further including a passive acoustic radiator expressed herein as augmented passive radiator 60 consisting of additional differential area passive radiator 64 and auxiliary enclosure volume 4. This system includes auxiliary enclosure volume 4 and one additional differential area passive radiator 64 which includes primary diaphragm surface area 65 and two secondary diaphragm surface areas smaller in acoustic coupling area than said primary diaphragm surface area. The secondary diaphragm surface areas include unitary diaphragm surface area 69 and differential diaphragm surface area 68. The primary diaphragm surface area 65 and the unitary diaphragm surface area 69 interconnect and include peripheral attachment means 66 and 67.

The differential diaphragm surface area 68 is defined by the differential surface area established between primary diaphragm surface area peripheral attachment means 66 and secondary diaphragm surface area peripheral attachment means 67. The unitary diaphragm surface area 69 of the additional differential area passive radiator 64 communicates into the auxiliary enclosure volume 4. The differential diaphragm surface area 68 of additional differential area passive radiator 64 communicates into primary enclosure volume 24. One side of primary diaphragm surface area 65 of additional differential area passive radiator communicates to a region outside of auxiliary enclosure volume 4, primary enclosure volume 20 and primary enclosure volume 24.

Figure 12A:
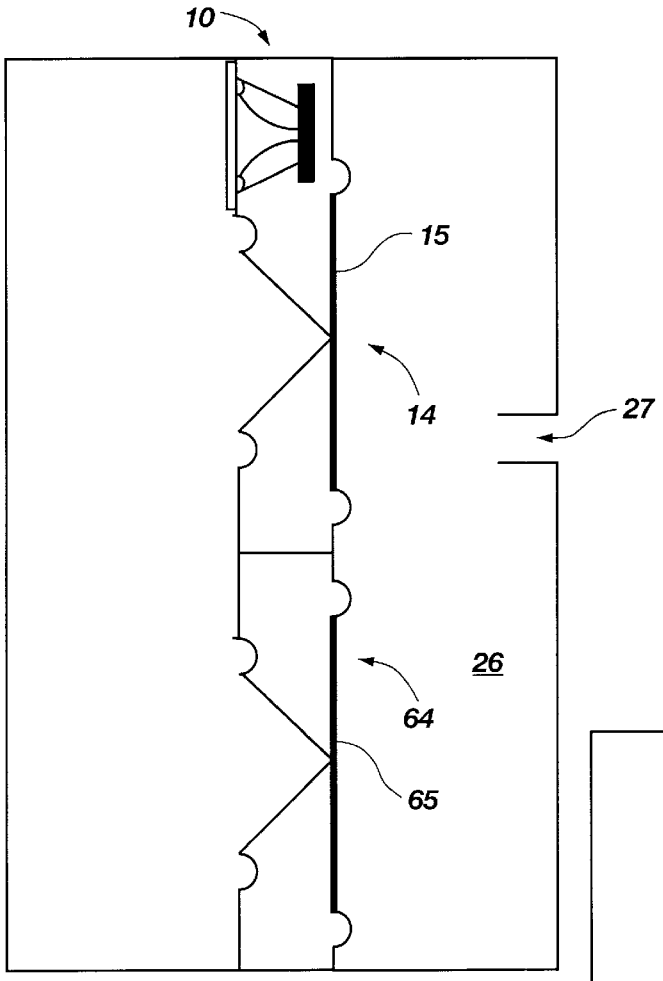
FIG. 12A shows the invention of FIG. 11A with an additional enclosure volume and port tuning frequency.

FIG. 12A is the bandpass loudspeaker enclosure system of FIG. 11A further including additional enclosure volume 26 attached to said bandpass loudspeaker enclosure system 10 and enclosing the outward surface of primary diaphragm surface area 15 of differential area passive radiator 14 and outward surface of primary diaphragm surface area 65 of additional differential area passive radiator 64 both communicating into additional enclosure volume 26. Passive acoustic energy radiator 27 acoustically couples the interior of additional enclosure volume 26 to the external environment. In this case the passive acoustic radiator is an elongated port.

Figure 12B:
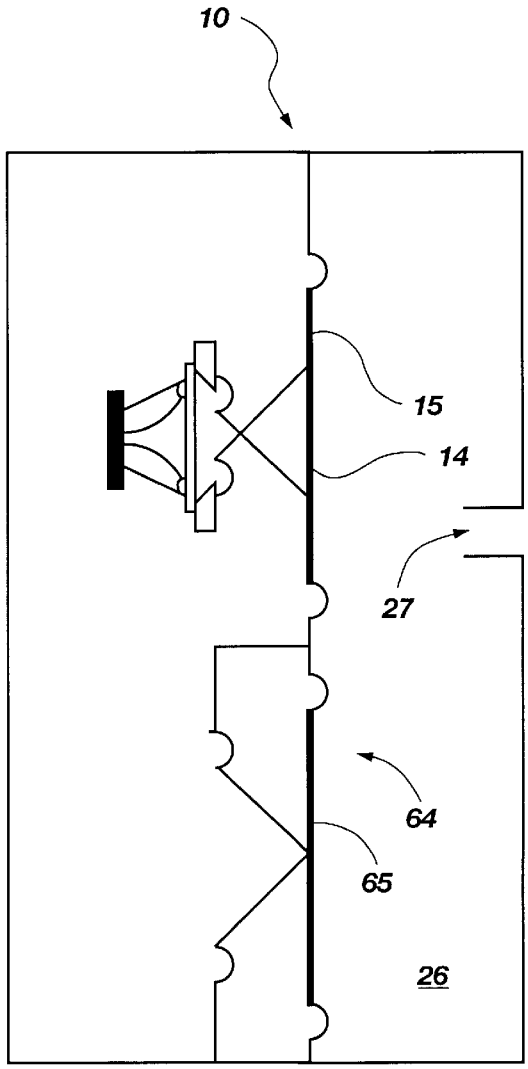
FIG. 12B shows a functional equivalent to FIG. 12A but of a different configuration.

FIG. 12B is the bandpass loudspeaker enclosure system of FIG. 11B further including additional enclosure volume 26 attached to the bandpass loudspeaker enclosure system 10 and enclosing the outward surface of primary diaphragm surface area 15 of differential area passive radiator 14 and outward surface of primary diaphragm surface area 65 of an additional differential area passive radiator 64 both communicating into additional enclosure volume 26. Passive acoustic energy radiator 27 acoustically couples the interior of additional enclosure volume 26 to the external environment. In this case the passive acoustic is an elongated port.

Figure 12C:
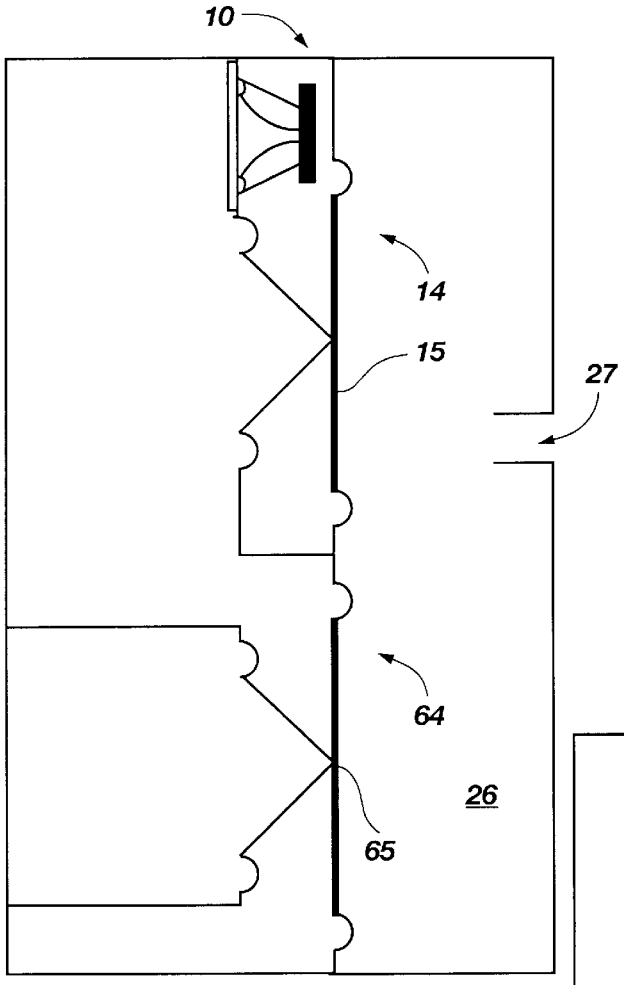
FIG. 12C shows a functional equivalent to FIG. 12A but of a different configuration.

FIG. 12C is the bandpass loudspeaker enclosure system of FIG. 11C further including additional enclosure volume 26 attached to bandpass loudspeaker enclosure system 10 and enclosing the outward surfaces of primary diaphragm surface area 15 of differential area passive radiator 14 and outward surface of primary diaphragm surface area 65 of additional differential area passive radiator 64 both communicating into additional enclosure volume 26. Passive acoustic energy radiator 27 acoustically couples the interior of additional enclosure volume 26 to the external environment. In this case the passive acoustic is an elongated port.

Figure 12D:
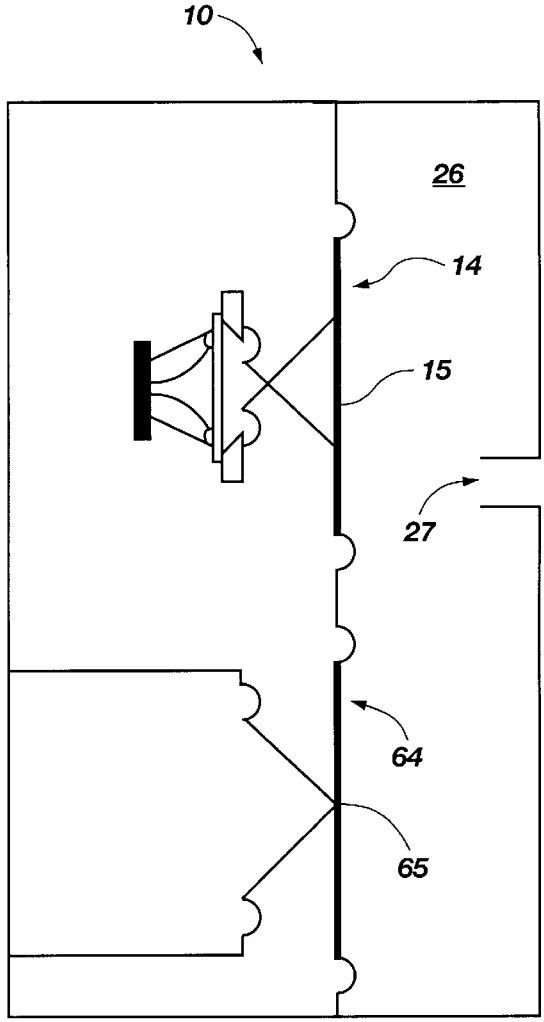
FIG. 12D shows a functional equivalent to FIG. 12A but of a different configuration.

FIG. 12D is the bandpass loudspeaker enclosure system of FIG. 11D further including additional enclosure volume 26 attached to bandpass loudspeaker enclosure system 10 and enclosing the outward surfaces of primary diaphragm surface area 15 of differential area passive radiator 14 and outward surface of primary diaphragm surface area 65 of additional differential area passive radiator 64 both communicating into additional enclosure volume 26. Passive acoustic energy radiator 27 acoustically couples the interior of said additional enclosure volume 26 to the external environment. In this case the passive acoustic is an elongated port.

Figure 13:
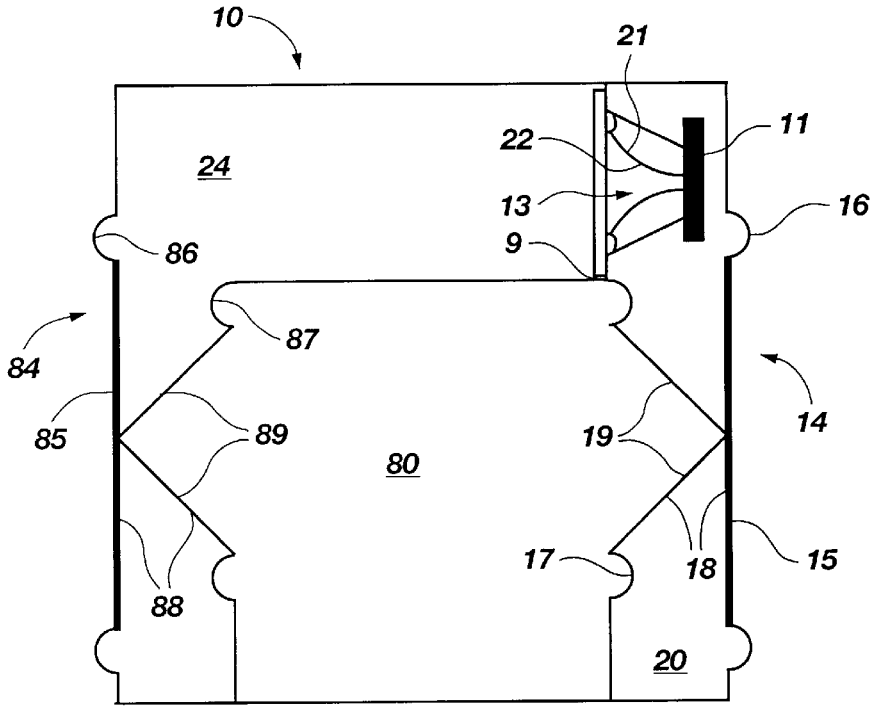
FIG. 13 shows the invention with each surface of the transducer coupled to a separate differential area passive radiator and each differential area passive radiator coupled to the other differential area passive radiator.

FIG. 13 shows a bandpass loudspeaker enclosure system 10 incorporating primary enclosure volume 20, primary enclosure volume 24, and primary enclosure volume 80. Dividing wall 9 is positioned between primary enclosure volumes 20 and 24. Electro-acoustic transducer 11 is mounted on dividing wall 9 and includes movable diaphragm 13 which has surface area side 21 and a surface area side 22. The surface area side 21 of movable diaphragm 13 communicates into primary enclosure volume 20 and surface area side 21 of movable diaphragm 13 communicates into primary enclosure volume 20. There are first and second differential area passive radiators 14 and 84 which include primary diaphragm surface areas 15 and 85 and two secondary diaphragm surface areas smaller in acoustic coupling area than the primary diaphragm surface areas. The secondary diaphragm surface areas include unitary diaphragm surface areas 19 and 89 and differential diaphragm surface areas 18 and 88. The primary diaphragm surface areas 15 and 85 are interconnected to unitary diaphragm surface areas 19 and 89 and include peripheral attachment means 16, 17, 86, and 87.

The differential diaphragm surface area 18 is defined by the differential surface area established between primary diaphragm surface area 15 peripheral attachment means 16 and secondary diaphragm surface area peripheral attachment means 17. The differential diaphragm surface area 88 is defined by the differential surface area established between primary diaphragm surface area 85, peripheral attachment means 86, and secondary diaphragm surface area peripheral attachment means 87. The surface area side 21 of electro-acoustic transducer 11 is pneumatically coupled through primary enclosure volume 20 to differential diaphragm surface area 18 of differential area passive radiator 14. The surface area side 22 of electro-acoustical transducer 11 is pneumatically coupled through primary enclosure volume 24 to differential diaphragm surface area 88 of second differential area passive radiator 84. The unitary diaphragm surface area 19 of differential area passive radiator 14 and the unitary diaphragm surface area 89 of differential area passive radiator 84 are pneumatically coupled to each other through primary enclosure volume 80. The primary diaphragm surface areas 15 and 85 of first and second differential area passive radiators 14 and 84 have one surface area side communicating outside of all three primary enclosure volumes 20, 24,and 80.

Figure 14:
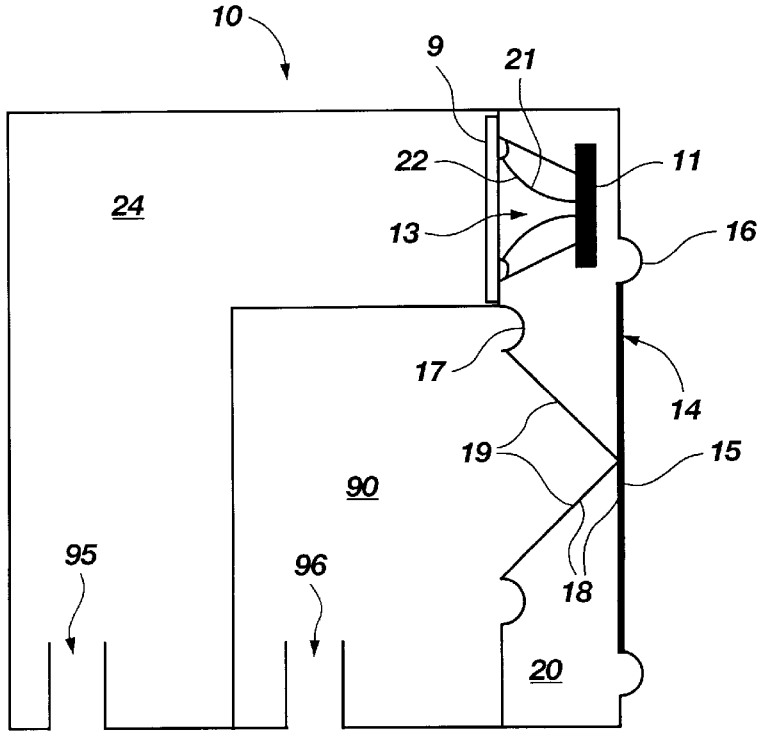
FIG. 14 shows the invention with the transducer coupled to a chamber which is coupled to a passive acoustic radiator and one surface of the differential area passive radiator coupled to a second chamber which is coupled to a passive acoustic radiator.

FIG. 14 shows a bandpass loudspeaker enclosure system 10 incorporating primary enclosure volume 20, primary enclosure volume 24 and primary enclosure volume 90. A dividing wall 9 is positioned between primary enclosure volumes 20 and 24. An electro-acoustic transducer 11 is mounted on dividing wall 9 and includes movable diaphragm 13 having a surface area side 21 and a surface area side 22. The surface area side 21 of movable diaphragm communicates into primary enclosure volume 20 and surface area side 22 of the movable diaphragm 13 communicates into primary enclosure volume 24. A differential area passive radiator 14 includes primary diaphragm surface area 15 and two secondary diaphragm surface areas, both smaller in acoustic coupling area than the primary diaphragm surface area 15. The secondary diaphragm surface areas include a unitary diaphragm surface area 19 and a differential diaphragm surface area 18. The primary diaphragm surface area 15 and unitary diaphragm surface area 19 are interconnected and include peripheral attachment means 16 and 17.

The differential diaphragm surface area 18 is defined by the differential surface area established between the primary diaphragm surface area peripheral attachment means 16 and unitary diaphragm surface area peripheral attachment means 17. The surface area 21 of the electro-acoustic transducer 11 is pneumatically coupled through primary enclosure volume 20 to differential diaphragm surface area 18 of differential area passive radiator 14. The surface area side 22 of the electro-acoustical transducer 11 is pneumatically coupled through primary enclosure volume 24 to passive acoustic energy radiator 95 which communicates from the interior to the exterior of primary enclosure volume 24. The passive acoustic radiator 95 is shown here as a port. Unitary diaphragm surface area 19 of differential area passive radiator 14 is pneumatically coupled through primary enclosure volume 90 to passive acoustic energy radiator 96 which communicates from the interior to the exterior of primary enclosure volume 90. Passive acoustic radiator 96 is shown here as a port. The primary diaphragm surface area 15 of differential area passive radiator 14 is communicates to a region outside of primary enclosure volumes 20, 24 and 90.

Figure 15A:
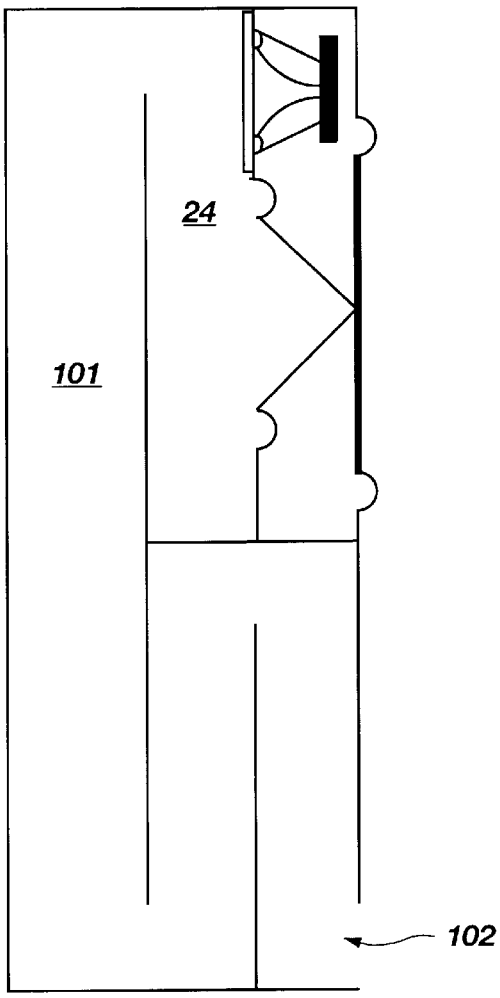
FIG. 15A shows the invention with one of the enclosure volumes including an acoustic transmission line.
Figure 15B:
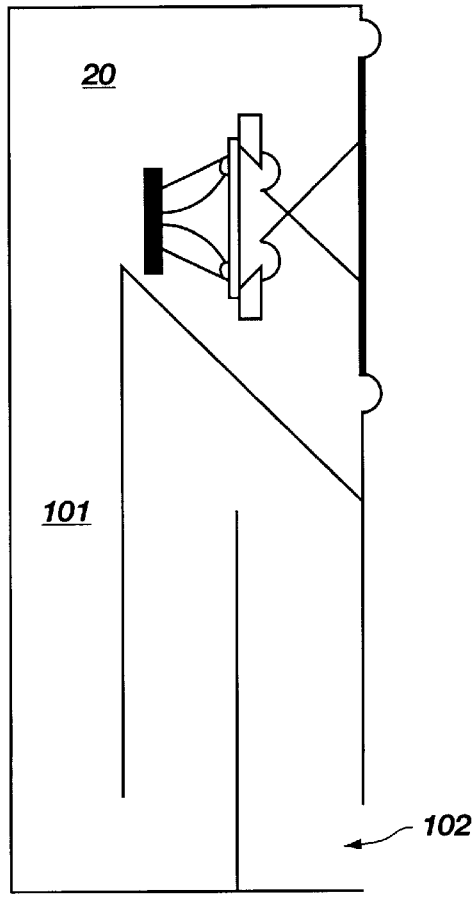
FIG. 15B shows a functional equivalent to FIG. 15A but of a different configuration.

FIG. 15A is the bandpass loudspeaker enclosure system of FIG. 5A with primary enclosure volume 24 embodying an acoustic transmission line 101 with transmission line vent 102. FIG. 15B is the bandpass loudspeaker enclosure system of FIG. 5B with primary enclosure volume 20 embodying an acoustic transmission line 101 with transmission line vent 102. The acoustic transmission line of FIGS. 15A and B could also be implemented as multiple transmission line elements.

Figure 17:
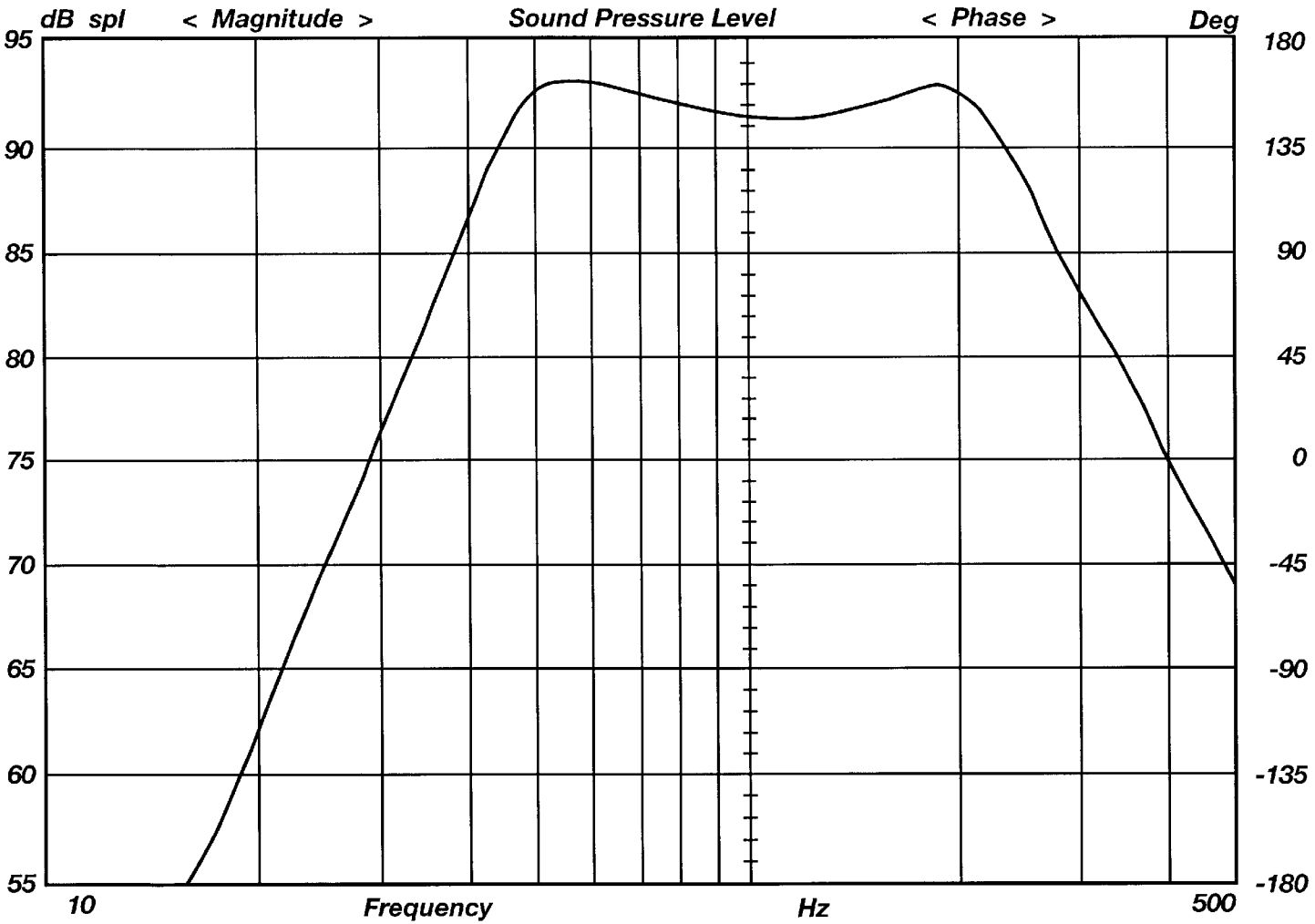
FIG. 17 is a frequency graph of one embodiment of the invention.

FIG. 16 is an impedance curve of an example of the embodiment of the invention shown in FIG. 7D. FIG. 17 is a frequency response curve of an example of the embodiment of the invention shown in FIG. 7D.

With all of the embodiments of the invention there is unique flexibility unavailable in the prior art due to the ability to vary the ratio relationships of the electro-acoustic transducer diaphragm 13 to that of the differential area passive radiator diaphragm area 19 or the differential area 18 of the differential area passive radiator 14. Also, the ability to vary the ratio relationship of differential area passive radiator unitary diaphragm 19 to that of differential area passive radiator primary diaphragm 15 gives further flexibility. With the invention the portion of the area of the differential area passive radiator 14 that is interacting with active transducer diaphragm 13 can be scaled to be smaller than the active transducer diaphragm 13 such that small movements of diaphragm 13 can cause larger movements in differential area passive radiator 14. This allows the active transducer diaphragm area (and associated structural framing 11*a*) to be reduced in size considerably without reducing the large signal performance of the system. It can also allow the active transducer 11 to have reduced excursion capability by having the greater movement transferred to the differential area passive radiator 14.

The active transducer 11 can be made for high force and small excursion and the differential area passive radiator 14 can be constructed for large excursions. This is of great benefit because it is easy to construct passive moving systems that can achieve large excursions but it is difficult to realize large force, large excursion and large diaphragm area in an active transducer. The only systems in the prior art that can achieve this kind of volume displacement reduction in the active transducer are very large and expensive horn systems. With the invention these attributes can be achieved in an enclosure system that is smaller relative to the prior art.

Many further variations will be obvious to one skilled in the art such as the type of diaphragm structures that can be used in all areas of diaphragm use. For example the diaphragms can be composed of a thin film, loudspeaker cones, a flat panel or other diaphragms used in the loudspeaker art. These may also be mixed between any of the diaphragm types and forms. Active transducers used in the systems described can be used in many orientations to achieve the equivalent result. Ratios of diaphragms, volumes and tunings can cover a broad range to achieve the desired result with the invention. Many prior art systems can be incorporated into the invention to create hybrids from systems known in the art such as Isobarik types, push-pull, negative spring systems and others known to one skilled in the art.

Many substitutions for the passive acoustic energy radiator are known in the art such as various versions of vents or ports, that can be either straight or flared, and also various versions of what are known as passive radiators, drone cones or auxiliary bass radiators. As is shown there are also many variations of constructions that can realize the performance of the component specified in the invention as the 'differential area passive radiator'. These can be standard loudspeaker cones, or any object with a surface area that can be pneumatically driven in the manner taught by the invention. It should also be obvious to the skilled in the are that the main enclosure 10 can take what ever form required to establish the bounding surfaces of the specified sub enclosures shown as 20 and 24 in most illustrations.

It is evident that those skilled in the art may now make numerous other modification of and departures from the specific apparatus and techniques herein disclosed without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A bandpass loudspeaker enclosure system including:

(a) a first primary enclosure volume, (b) a second primary enclosure volume, (c) a dividing wall positioned between said first and second primary enclosure volumes and having a first opening therein;

(d) at least one electro-acoustic transducer mounted at the opening on the dividing wall and including a movable diaphragm having a first surface area side and a second surface area side, said first surface area side of said movable diaphragm communicating into said first primary enclosure volume and said second surface area side of said movable diaphragm communicating into said second primary enclosure volume;

e) at least one differential area passive radiator including (i) a primary diaphragm surface area having a primary peripheral attachment means, and (ii) secondary diaphragm surface area having at least a secondary peripheral attachment means, said secondary diaphragm surface area including:

(1) a unitary diaphragm surface area having a perimeter defined by the secondary peripheral attachment means and forming part of an interior surface of one of said first or second primary enclosure volumes;

(2) a differential diaphragm surface area having a first perimeter defined by the secondary peripheral attachment means and a second perimeter defined by the primary peripheral attachment means, said differential diaphragm surface area forming part of an interior surface of the remaining first or second primary enclosure volume;

said unitary diaphragm surface area of said at least one differential area passive radiator being mounted by said secondary peripheral attachment means in a second opening in a wall between said first and second primary enclosure volumes;

said first surface area side of said electro-acoustic transducer being pneumatically coupled through said first primary enclosure volume to said unitary diaphragm surface area of said differential area passive radiator;

said second surface area side of the electro-acoustical transducer being pneumatically coupled through said second primary enclosure volume to said differential diaphragm surface area of said at least one differential area passive radiator;

said primary diaphragm surface area of said at least one differential area passive radiator being mounted by said peripheral attachment means in an opening in said second primary enclosure volume and, said primary diaphragm surface area of said at least one differential area passive radiator communicating from said opening in said second primary enclosure volume to a region outside of said first and second primary enclosure volumes.

2. A bandpass loudspeaker enclosure system as in claim 1 including a passive acoustic energy radiator communicating from an interior of one of two said primary enclosure volumes to the exterior of said one of two said primary enclosure volumes, said passive acoustic radiator having the characteristic of acoustic mass and being selected from the group consisting of vents, ports, and suspended passive diaphragms.

3. A bandpass loudspeaker enclosure system as in claim 2 including an additional primary enclosure volume, coupled adjacent to the second primary enclosure volume and sharing a common boundary wall with said second primary enclosure volume; said passive acoustic energy radiator communicating from an interior of one of the two primary enclosure volumes into said additional enclosure volume, said primary diaphragm surface area of said at least one differential area passive radiator having one side communicating through said boundary wall into said additional enclosure volume, and further including a second passive acoustic energy radiator acoustically coupling the interior of said additional primary enclosure volume to the external environment, said second passive acoustic radiator having the characteristic of acoustic mass and being selected from the group consisting of vents, ports, and suspended passive diaphragms.

4. A bandpass loudspeaker enclosure system as in claim 2 including:

an additional primary enclosure volume coupled adjacent to the second primary enclosure volume and sharing a common boundary wall with said second primary enclosure volume;

said passive acoustic energy radiator communicating from an interior of one primary enclosure volume to the external environment;

said primary diaphragm surface area of said at least one differential area passive radiator communicating through said boundary wall into said additional enclosure volume;

a second passive acoustic energy radiator acoustically communicating from the interior of said additional enclosure to the external environment;

said passive acoustic radiator having the characteristic of acoustic mass and being selected from the group consisting of vents, ports, and suspended passive diaphragms.

5. A bandpass loudspeaker enclosure system as in claim 1 including:

an additional primary enclosure volume coupled adjacent to the second primary enclosure volume and sharing a common boundary wall with said second primary enclosure volume;

said primary diaphragm surface area of said differential area passive radiator having one side communicating through said boundary wall into said additional enclosure volume;

a passive acoustic energy radiator acoustically coupling the inside of said additional enclosure volume to the outside environment;

said passive acoustic radiator having the characteristic of acoustic mass and being selected from the group consisting of vents, ports, and suspended passive diaphragms.

6. A bandpass loudspeaker enclosure system as in claim 1 including:

an auxiliary enclosure volume acoustically coupled to at least one of said first and second enclosure volumes;

at least one additional differential area passive radiator including (i) a first of said two secondary diaphragm surface areas of said at least one additional differential area passive radiator communicating into said auxiliary enclosure volume second of said two secondary diaphragm surface areas of said at least one additional differential area passive radiator communicating into one of said first or second primary enclosure volumes, one side of said primary diaphragm surface area of said at least one additional differential area passive radiator communicating to a region outside of said auxiliary enclosure volume and said first and second primary enclosure volumes of claim 1.

7. A bandpass loudspeaker enclosure system as in claim 6 including;

an additional primary enclosure volume attached to said bandpass loudspeaker enclosure system and enclosing an outward surface of said primary diaphragm surface area of said at least one differential area passive radiator;

one side of said primary diaphragm surface area of said at least one additional differential area passive radiator communicating into said additional enclosure volume;

one side of said primary diaphragm surface area of said at least one differential area passive radiator having one surface area communicating into said additional enclosure volume; and a passive acoustic energy radiator acoustically coupling the interior of said additional enclosure volume to the external environment;

said passive acoustic radiator having the characteristic of acoustic mass and being selected from the group consisting of vents, ports, and suspended passive diaphragms.

8. A bandpass loudspeaker enclosure system as in claim 1 including;

a passive acoustic energy radiator communicating from the interior of one of said primary enclosure volumes to the exterior of one of said primary enclosure volumes, said passive acoustic radiator having the characteristic of acoustic mass and selected from the group consisting of vents, ports, suspended passive diaphragms, and augmented passive radiators.

9. A bandpass loudspeaker enclosure system as in claim 1 wherein one of two said primary enclosure volumes contains at least one acoustic transmission line.

10. A system as defined in claim 1, wherein the loudspeaker enclosure system comprises a total of two enclosure volumes consisting of the first and second primary enclosure volumes.

11. A bandpass loudspeaker enclosure system as in claim 10, including:

at least one passive acoustic energy radiator communicating from an interior of one of said two primary enclosure volumes to the exterior of said one of two said primary enclosure volumes;

said passive acoustic radiator having the characteristic of acoustic mass and being selected from the group consisting of vents, ports, and suspended passive diaphragms.

12. A bandpass loudspeaker enclosure system as in claim 10 wherein one of said two primary enclosure volumes contains at least one acoustic transmission line.

13. A bandpass loudspeaker enclosure system as in claim 10 wherein one of said two primary enclosure volumes contains at least one acoustic transmission line which exits to a region outside of said two primary enclosure volumes.

14. A bandpass loudspeaker enclosure system including:

(a) a primary enclosure volume with at least a first opening and a second opening therein;

(b) at least one electro-acoustic transducer mounted on the first opening and including a movable diaphragm having a first surface area side and a second surface area side, (c) at least one differential area passive radiator including (I) a primary diaphragm surface area having a primary peripheral attachment means, and (ii) a secondary diaphragm surface area having at least a secondary peripheral attachment means, said secondary diaphragm surface area including:

(1) a unitary diaphragm surface area having a perimeter defined by the secondary peripheral attachment means; and, (2) a differential diaphragm surface area having a first perimeter defined by the secondary peripheral attachment means and a second perimeter defined by the primary peripheral attachment means, said respective differential diaphragm surface area and said unitary diaphragm surface area alternatively forming, respectively: a part of an interior surface of the primary enclosure volume and a surface area open to an outside environment; or, respectively, a surface area open to an outside environment and a part of an interior surface of the primary enclosure volume;

said unitary diaphragm surface area of said at least one differential area passive radiator being mounted by said secondary peripheral attachment means in the second opening in the primary enclosure volume;

one surface area side of said electro-acoustic transducer movable diaphragm being pneumatically coupled through said primary enclosure volume to either the unitary diaphragm surface area or the differential diaphragm surface area of said at least one differential area passive radiator.

15. A bandpass loudspeaker enclosure system in claim 14 including:

an additional enclosure volume formed as part of the loudspeaker enclosure system;

said primary diaphragm surface area of said differential area passive radiator communicating into said additional enclosure volume;

a passive acoustic energy radiator acoustically coupling at least one additional enclosure to the exterior environment;

said passive acoustic radiator having the characteristic of acoustic mass and being selected from the group consisting of vents, ports, and suspended passive diaphragms.

16. A bandpass loudspeaker enclosure system in claim 15 wherein at least one of the diaphragm surface areas of the differential area passive radiator is constructed of a thin film material.

17. A bandpass loudspeaker enclosure system in claim 14 wherein at least one of the diaphragm surface areas of the differential area passive radiator is constructed of a thin film material.

18. A bandpass speaker system as in claim 14, further comprising a wall attached to an exterior of the primary enclosure volume, said wall having at least one opening therethrough, said wall forming with the primary enclosure volume an open dipole configuration; said peripheral attachment means of said primary diaphragm surface area of said at least one differential area passive radiator being mounted in said at least one opening in said wall attached to said primary enclosure volume.

19. A bandpass loudspeaker enclosure system including:

(a) first and second primary enclosure volumes each including a first wall with a first opening and a second wall with a second opening;

(b) a dividing wall positioned between said first and second primary enclosure volumes, said dividing wall including an opening;

(c) at least one electro-acoustic transducer mounted on the opening on the dividing wall and including a movable diaphragm having a first surface area side and a second surface area side, said first surface area side of said movable diaphragm communicating into said first primary enclosure volume and said second surface area side of said movable diaphragm communicating into said second primary enclosure volume;

(e) first and second differential area passive radiators being coupled at said first and second openings, and including (i) a primary diaphragm surface area having a primary peripheral attachment means, and (ii) secondary diaphragm surface area having at least a secondary peripheral attachment means, said secondary diaphragm surface area including:

(1) a unitary diaphragm surface area having a perimeter defined by the secondary peripheral attachment means;

(2) a differential diaphragm surface area having a first perimeter defined by the secondary peripheral attachment means and a second perimeter defined by the primary peripheral attachment means;

said unitary diaphragm surface area of said first differential area passive radiator being mounted by said secondary peripheral attachment means in the first opening in the first wall of said first primary enclosure volume;

said unitary diaphragm surface area of said second differential area passive radiator being mounted by said secondary peripheral attachment means in the first opening in the first wall of said second primary enclosure volume;

said first surface area side of the electro-acoustic transducer being pneumatically coupled through said first primary enclosure volume to differential diaphragm surface area of said first differential area passive radiator;

said second surface area side of the electro-acoustical transducer pneumatically coupled through said second primary enclosure volume to the differential diaphragm surface area of said second differential area passive radiator;

said primary diaphragm surface area of said first differential area passive radiator being mounted by its primary peripheral attachment means in the second opening in said first primary enclosure volume, said primary diaphragm surface area of said second differential area passive radiator being mounted by its primary peripheral attachment means in the second opening in said second primary enclosure volume.

20. A system as defined in claim 19, wherein the loudspeaker enclosure system comprises a total of two enclosure volumes consisting of the first and second primary enclosure volumes.

21. A bandpass loudspeaker enclosure system as in claim 20, including:

a passive acoustic energy radiator communicating from an interior to an exterior of one of said two primary enclosure volumes;

said passive acoustic radiator having the characteristic of acoustic mass and being selected from the group consisting of vents, ports, and suspended passive diaphragms.

22. A bandpass loudspeaker enclosure system incorporating:

(a) a first primary enclosure volume;

(b) a second primary enclosure volume;

(c) a third primary enclosure volume;

(d) a dividing wall positioned between said first and second primary enclosure volumes;

(e) at least one electro-acoustic transducer mounted on the dividing wall and including a movable diaphragm having a first surface area side and a second surface area side, said first surface area side of said movable diaphragm communicating into said first primary enclosure volume and said second surface area side of said movable diaphragm communicating into said second primary enclosure volume;

(f) a first and a second differential area passive radiator each including (i) a primary diaphragm surface area having a primary peripheral attachment means, and (ii) secondary diaphragm surface area having at least a secondary peripheral attachment means, said secondary diaphragm surface area including:

(1) a unitary diaphragm surface area having a perimeter defined by the secondary peripheral attachment means and forming part of an interior surface of one of said first or second primary enclosure volumes;

(2) a differential diaphragm surface area having a first perimeter defined by the secondary peripheral attachment means and a second perimeter defined by the primary peripheral attachment means, said differential diaphragm surface area forming part of an interior surface of the remaining first or second primary enclosure volume;

said unitary diaphragm surface area of said at least one differential area passive radiator being mounted by said secondary peripheral attachment means in the second opening in the primary enclosure volume;

said first surface area side of said electro-acoustic transducer being pneumatically coupled through said first primary enclosure volume to a first of two said secondary diaphragm surface areas of said first differential area passive radiator;

said second surface area side of said electro-acoustical transducer being pneumatically coupled through said second primary enclosure volume to a first of two said secondary diaphragm surface areas of said second differential area passive radiator;

said second of said secondary diaphragm surface areas of said first and second differential area passive radiators being pneumatically coupled to each other through said third primary enclosure volume;

said primary diaphragm surface area of said first and second differential area passive radiators having one surface area side communicating outside of said first, second and third primary enclosure volumes.

23. A bandpass loudspeaker enclosure system incorporating:

(a) a first primary enclosure volume;

(b) a second primary enclosure volume;

(c) a third primary enclosure volume;

(d) a dividing wall positioned between said first and second primary enclosure volumes;

(e) at least one electro-acoustic transducer mounted on the dividing wall and including a movable diaphragm having a first surface area side and a second surface area side;

said first surface area side of said movable diaphragm communicating into said first primary enclosure volume and said second surface area side of said movable diaphragm communicating into said second primary enclosure volume;

f) at least one differential area passive radiator including (i) a primary diaphragm surface area having a primary peripheral attachment means, and (ii) secondary diaphragm surface area having at least a secondary peripheral attachment means, said secondary diaphragm surface area including:

(1) a unitary diaphragm surface area having a perimeter defined by the secondary peripheral attachment means and forming part of an interior surface of one of said first or second primary enclosure volumes;

(2) a differential diaphragm surface area having a first perimeter defined by the secondary peripheral attachment means and a second perimeter defined by the primary peripheral attachment means, said differential diaphragm surface area forming part of an interior surface of the remaining first or second primary enclosure volume;

said unitary diaphragm surface area of said at least one differential area passive radiator being mounted by said secondary peripheral attachment means in the second opening in the primary enclosure volume;

said first surface area side of the electro-acoustic transducer pneumatically coupled through said first primary enclosure volume to a first of two said secondary diaphragm surface areas of said differential area passive radiator;

said second surface area side of the electro-acoustical transducer being pneumatically coupled through said second primary enclosure volume to and further including a first passive acoustic energy radiator communicating from the interior to the exterior of said second primary enclosure volume, said passive acoustic radiator having the characteristic of acoustic mass and being selected from the group consisting of vents, ports, and suspended passive diaphragms;

said secondary diaphragm surface area of said differential area passive radiator being pneumatically coupled through said third primary enclosure volume to a second passive acoustic energy radiator communicating from the inside to the outside of said third primary enclosure volume, said passive acoustic radiator having the characteristic of acoustic mass and being selected from the group consisting of vents, ports, and suspended passive diaphragms;

said primary diaphragm surface area of said differential area passive radiator having at least one surface area side communicating to the external environment.

24. A bandpass loudspeaker enclosure system including:

(a) a first primary enclosure volume;

(b) a second primary enclosure volume;

(c) a dividing wall positioned between said first and second primary enclosure volumes and having a first opening therein;

(d) at least one electro-acoustic transducer mounted on the opening on the dividing wall and including a movable diaphragm having a first surface area side and a second surface area side, said first surface area side of said movable diaphragm communicating into said first primary enclosure volume and said second surface area side of said movable diaphragm communicating into said second primary enclosure volume;

e) at least one differential area passive radiator including a first relatively large loudspeaker diaphragm defining a large diaphragm surface area with respect to and including a second smaller loudspeaker diaphragm defining a small diaphragm surface area, said diaphragms being connected to each other in a back to back relationship;

said loudspeaker diaphragms having a surround-attachment means around the periphery of the loudspeaker diaphragms;

said differential area passive radiator having a differential diaphragm surface area defined by the diaphragm surface area contained between the surround-attachment means of the relatively large loudspeaker diaphragm and the surround-attachment means of the small loudspeaker diaphragm;

said first surface area side of said electro-acoustic transducer being pneumatically coupled through said first primary enclosure volume to said small diaphragm surface area of said differential area passive radiator;

said second surface area side of the electro-acoustic transducer being pneumatically coupled through said second primary enclosure volume to said differential diaphragm surface area of said at least one differential area passive radiator;

said large diaphragm surface area of said at least one differential area passive radiator being mounted by said surround-attachment means in an opening in said second primary enclosure volume and communicating from said opening in said second primary enclosure volume to a region outside of said first and second primary enclosure volumes.

25. A bandpass loudspeaker enclosure system as in claim 24 including a passive acoustic energy radiator communicating from an interior of one of said primary enclosure volumes to the exterior of said one of said primary enclosure volumes, said passive acoustic radiator having the characteristic of acoustic mass and being selected from the group consisting of vents, ports, and suspended passive diaphragms.

26. A bandpass loudspeaker enclosure system as in claim 24 wherein one of said primary enclosure volumes contains at least one acoustic transmission line which exits to a region outside said enclosure volumes.

27. A bandpass loudspeaker enclosure system including:

(a) at least one electro-acoustic transducer with a vibratile diaphragm having a front acoustical coupling surface and a back acoustical coupling surface;

(b) at least one differential area passive radiator with three independent acoustical coupling surface areas;

(c) said front acoustical coupling surface of the said vibratile diaphragm being substantially air coupled through a first enclosure volume to a first of three independent acoustical coupling surface areas of said at least one differential area passive radiator;

(d) said rear acoustical coupling surface of the said vibratile diaphragm substantially air coupled through a second enclosure volume to a second of the three independent acoustical coupling surface areas of said at least one differential area passive radiator;

(e) a third of the three independent acoustical coupling surface areas of said at least one differential area passive radiator communicating outside of said first and second enclosure volumes.

28. A bandpass loudspeaker enclosure system as in claim 27, including a passive acoustic energy radiator communicating from an interior of one of said primary enclosure volumes to the exterior of said one of said primary enclosure volumes, said passive acoustic radiator having the characteristic of acoustic mass and being selected from the group consisting of vents, ports, and suspended passive diaphragms.

29. A bandpass loudspeaker enclosure system as in claim 27, including a passive acoustic energy radiator communicating from the interior to the exterior of one of said enclosure volumes, said passive acoustic radiator having the characteristic of acoustic mass and selected from the group consisting of vents, ports, suspended passive diaphragms, and augmented passive radiators.

30. A bandpass loudspeaker enclosure system as in claim 27 wherein one of two said enclosure volumes contains at least one acoustic transmission line which exits to a region outside of said primary enclosure volumes.

31. A bandpass loudspeaker enclosure system including:

(a) at least one electro-acoustic transducer with a vibratile diaphragm having a front acoustical coupling surface and a back acoustical coupling surface;

(b) at least one differential area passive radiator with three independent acoustical coupling surface areas;

(c) said front acoustical coupling surface of the said vibratile diaphragm substantially air coupled through a first enclosure volume to a first of the three independent acoustical coupling surface areas of said at least one differential area passive radiator; and (d) a second of three independent acoustical coupling surface areas of said at least one differential area passive radiator communicating in a first substantially forward direction and said rear acoustical coupling surface of the said vibratile diaphragm and a third of three independent acoustical coupling surface areas of said at least one differential area passive radiator arranged to communicate in a second substantially rearward direction.

32. A bandpass loudspeaker enclosure system incorporating:

a primary enclosure structure with at least one interior wall partitioning an interior thereof into a total of two enclosure volumes;

an electro-acoustic transducer mounted on the at least one interior wall; and, a differential area passive radiator mounted between and connected to said at least one interior wall and an exterior of said enclosure said electro-acoustic transducer being pneumatically coupled to the differential area passive radiator through each of said two enclosure volumes.

33. A bandpass loudspeaker enclosure system as in claim 32 including:

a passive acoustic energy radiator communicating from an interior of one of said two enclosure volumes to the exterior of said one of two enclosure volumes;

said passive acoustic radiator having the characteristic of acoustic mass and being selected from the group consisting of vents, ports, and suspended passive diaphragms.

34. A bandpass loudspeaker enclosure system incorporating:

a primary enclosure structure with at least two inner walls partitioning an interior thereof into at least three interior enclosure volumes;

an electro-acoustic transducer mounted on one of the at least two inner walls;

a differential area passive radiator mounted between and connected to two of said inner walls;

at least one passive acoustic radiator communicating from an interior of one of said enclosure volumes to an exterior of said primary enclosure structure;

said passive acoustic radiator having the characteristic of acoustic mass and being selected from the group consisting of vents, ports, and suspended passive diaphragms.

35. A bandpass loudspeaker enclosure system as in claim 34 including:

a passive acoustic energy radiator communicating from an interior of a first of said at least three interior enclosure volumes to an interior of a second of said at least three interior enclosure volumes;

said passive acoustic radiator having the characteristic of acoustic mass and being selected from the group consisting of vents, ports, and suspended passive diaphragms.

36. A bandpass loudspeaker enclosure system incorporating:

a primary enclosure structure with at least two inner walls partitioning an interior thereof into three interior enclosure volumes;

an electro-acoustic transducer mounted on one of the at least two interior walls;

a first differential area passive radiator with three separate acoustic surface areas and being mounted between and connected to a first of said at least two interior walls and an exterior of said enclosure structure;

a second differential area passive radiator with three separate acoustic surface areas and being mounted between and connected to a second of said at least two interior walls and the exterior of said enclosure structure;

one of the three acoustic surface areas of said first differential area passive radiator and one of the three of said acoustic surface areas of said second differential area passive radiator being pneumatically coupled through one of said three interior enclosure volumes.

37. A bandpass loudspeaker enclosure system incorporating:

a primary enclosure structure with least two inner walls partitioning an interior thereof into three interior enclosure volumes;

an electro-acoustic transducer mounted on one of the at least two interior walls;

a differential area passive radiator mounted between and connected to a first of said at least two interior walls and an exterior of said primary enclosure structure;

a first passive acoustic radiator communicating from an interior of a first of said three interior enclosure volumes to the exterior of said primary enclosure structure;

said passive acoustic radiator having the characteristic of acoustic mass and being selected from the group consisting of vents, ports, and suspended passive diaphragms;

a second passive acoustic radiator communicating from an interior of a second of said three interior enclosure volumes to the exterior of said primary enclosure structure;

said passive acoustic radiator having the characteristic of acoustic mass and being selected from the group consisting of vents, ports, and suspended passive diaphragms.

* * * * *